US008921678B2

(12) United States Patent
Usui et al.

(10) Patent No.: US 8,921,678 B2
(45) Date of Patent: Dec. 30, 2014

(54) GENERATING TONES BY COMBINING SOUND MATERIALS

(75) Inventors: Jun Usui, Hamamatsu (JP); Taishi Kamiya, Tokyo (JP)

(73) Assignee: Yamaha Corporation, Hamamatsu-shi (JP)

( * ) Notice: Subject to any disclaimer, the term of this patent is extended or adjusted under 35 U.S.C. 154(b) by 87 days.

(21) Appl. No.: 13/411,188

(22) Filed: Mar. 2, 2012

(65) Prior Publication Data

US 2012/0222540 A1 Sep. 6, 2012

(30) Foreign Application Priority Data

Mar. 2, 2011 (JP) ..... 2011-045708
Nov. 4, 2011 (JP) ..... 2011-242606

(51) Int. Cl.
*G10H 7/00* (2006.01)

(52) U.S. Cl.
USPC ..... 84/600; 84/602

(58) Field of Classification Search
USPC ..... 84/600–602; 700/94
See application file for complete search history.

(56) References Cited

U.S. PATENT DOCUMENTS 8,106,286 B2 * 1/2012 Mizuhiki et al. ..... 84/622
8,153,882 B2 * 4/2012 Adam et al. ..... 84/627
8,309,834 B2 * 11/2012 Gehring et al. ..... 84/613
8,415,549 B2 * 4/2013 Adam et al. ..... 84/627
8,445,768 B1 * 5/2013 Classen et al. ..... 84/633
2005/0108357 A1 * 5/2005 Sano ..... 709/217
2008/0271592 A1 * 11/2008 Beckford ..... 84/645
2009/0019992 A1 * 1/2009 Mizuhiki et al. ..... 84/604
2010/0132536 A1 * 6/2010 O'Dwyer ..... 84/609
2010/0199832 A1 * 8/2010 Mizuhiki et al. ..... 84/604
2010/0250510 A1 9/2010 Herberger et al.
2011/0011245 A1 * 1/2011 Adam et al. ..... 84/612
2011/0011246 A1 * 1/2011 Buskies et al. ..... 84/613
2011/0247479 A1 * 10/2011 Helms et al. ..... 84/613

(Continued)

FOREIGN PATENT DOCUMENTS

EP 1 666 967 A1 6/2006
EP 1 923 863 A1 5/2008

(Continued)

OTHER PUBLICATIONS

Logic Pro 8 User Manual (2007, viewed online at http://manuals.info.apple.com/en_US/Logic_Pro_8_User_Manual.pdf).*

(Continued)

*Primary Examiner* — David S. Warren
(74) *Attorney, Agent, or Firm* — Morrison & Foerster LLP

(57) ABSTRACT

The apparatus displays, on a display screen, an icon placement region having a time axis defined therein, and displays, in accordance with an input instruction, an icon image with which feature amount information of material data indicative of a sound material is associated. The apparatus further sets a type of a feature amount database, where material data and feature amount information of the material data are associated with each other, along the time axis in accordance with an input instruction. Then, the apparatus references the feature amount database of a type having correspondence relationship in time axis with an icon image to identify material data similar to the feature amount information corresponding to the icon image, and audibly generates a sound at timing corresponding to a position, on the time axis, of the icon image and with content corresponding to the identified material data.

21 Claims, 18 Drawing Sheets

FEATURE AMOUNT DB

| CLASS | CLIPPED DATA | DATA RANGE | FEATURE AMOUNT INFO. |
|---|---|---|---|
| CLASS A | CLIPPED DATA A | ts1~te1 | Pa(p1,p2,•••) |
| | ⋮ | ⋮ | ⋮ |
| ⋮ | ⋮ | ⋮ | ⋮ |

(56) References Cited

U.S. PATENT DOCUMENTS

| | | | | |
|---|---|---|---|---|
| 2011/0247480 | A1* | 10/2011 | Gehring et al. | 84/613 |
| 2011/0259176 | A1* | 10/2011 | Pillhofer et al. | 84/470 R |
| 2012/0017748 | A1* | 1/2012 | Beck | 84/483.2 |
| 2012/0060668 | A1* | 3/2012 | Lengeling et al. | 84/645 |
| 2012/0180619 | A1* | 7/2012 | Adam et al. | 84/612 |
| 2012/0222540 | A1* | 9/2012 | Usui et al. | 84/622 |
| 2013/0061735 | A1* | 3/2013 | Gehring et al. | 84/622 |
| 2013/0112067 | A1* | 5/2013 | Lengeling et al. | 84/645 |
| 2013/0205977 | A1* | 8/2013 | Buskies et al. | 84/613 |
| 2013/0220102 | A1* | 8/2013 | Savo et al. | 84/609 |

FOREIGN PATENT DOCUMENTS

| | | | |
|---|---|---|---|
| EP | 2 017 822 | A2 | 1/2009 |
| EP | 2 048 654 | A1 | 4/2009 |
| JP | 2010-191337 | A | 9/2010 |
| WO | WO-03/036613 | A1 | 5/2003 |

OTHER PUBLICATIONS

Anonymous. (2008). "MIDI Messages," MIDI Manufacturer's Association, Inc., located at http://web/archive.org/web/20090316062214/http://www/midi.org/tecspecs/midimessages.php, last visited on Sep. 16, 2011, 12 pages.

Carlson, L. et al. (2004). "Cubase SE Music Creation and Production System: Operation Manual," Steinberg Media Technologies, GmbH, located at http://www.cmis.brighton.ac.uk/staff/alb14/CI221/Teaching_&_Assessment_Schedule/assets/Operation_Manual.pdf, last visited on Feb. 2, 2016, 627 pages. (submitted in three parts.).

European Search Report mailed Jun. 28, 2012, for EP Patent Application No. 12157886.8, nine pages.

Hufford, C. et al. (Nov. 7, 2004). "Online Documentation for Smartsound® Sonicfire® Pro Version 3.2," located at http://web.archive.org/web/20041107205935/http://smartsound.com/sonicfire/docs/SonicfirePro.pdf, last visited Mar. 22, 2006, 136 pages.

* cited by examiner

FEATURE AMOUNT DB

| CLASS | CLIPPED DATA | DATA RANGE | FEATURE AMOUNT INFO. |
|---|---|---|---|
| CLASS A | CLIPPED DATA A | ts1~te1 | Pa(p1,p2,•••) |
| | ⋮ | ⋮ | ⋮ |
| ⋮ | ⋮ | ⋮ | ⋮ |

EXTRACTED DATA

| MUSIC PIECE DATA | DATA RANGE | FEATURE AMOUNT INFO. | CLASS | REPLACING MATERIAL DATA |
|---|---|---|---|---|
| MUSIC PIECE DATA A | ts2~te2 | Pb(p1,p2,•••) | CLASS A | W5, W1, W2, ••• |
| | ⋮ | ⋮ | ⋮ | ⋮ |
| ⋮ | ⋮ | ⋮ | ⋮ | ⋮ |

FEATURE AMOUNT DESIGNATING DATA

| REPRO. TIME | FEATURE AMOUNT INFO. | SOUND VOLUME |
|---|---|---|
| ⋮ | ⋮ | ⋮ |
| 0001:04:480 | Pc(p1,p2,•••) | 20 |
| 0002:01:000 | Pd(p1,p2,•••) | 40 |
| 0002:01:000 | Pe(p1,p2,•••) | 10 |
| ⋮ | ⋮ | ⋮ |

F I G. 6 A

DB DESIGNATING DATA

| REPRO. TIME RANGE | DB |
|---|---|
| 0001:01:000 ~ 0001:03:959 | DBa |
| 0001:03:000 ~ 0001:04:959 | DBc |
| ⋮ | ⋮ |

F I G. 6 B

TEMPLATE DATA (template2)

| TRACK | FEATURE AMOUNT INFO. | SOUND GENERATION TIMING |
|---|---|---|
| 1 | Pf(p1,p2,•••) | 1:360 |
| | | 1:600 |
| | | 1:1080 |
| 2 | Pg(p1,p2,•••) | 1:240 |
| | | 1:720 |
| | | 1:1200 |
| | | 1:1680 |
| 3 | Ph(p1,p2,•••) | 1:600 |
| | | 1:1320 |
| 4 | Pi(p1,p2,•••) | 1:0 |
| | | 1:480 |
| | | 1:960 |
| | | 1:1440 |

FIG. 15

GENERATING TONES BY COMBINING SOUND MATERIALS

BACKGROUND

The present invention relates to techniques for combining sound materials and audibly generating tones or musical sounds on the basis of the combined sound materials.

Heretofore, there have been known technique for prestoring a multiplicity of fragmentary sound materials in a database and selectively combining some of the prestored sound materials to generate tones (i.e., tone waveforms) on the basis of the combined sound materials. Individual sound materials to be used for generation of tones are selected from among the multiplicity of sound materials prestored in the database. To facilitate the selection of the sound materials, the multiplicity of sound materials stored in the database are classified into categories indicative of various musical characters or features. Japanese Patent Application Laid-open Publication No. 2010-191337 discloses a technique for extracting a plurality of sound materials from continuous sound waveforms of a multiplicity of music pieces, classifying the extracted sound materials into various categories and then storing the thus-classified sound materials into a database.

A sound generation style in which tones are to be audibly generated using some of the sound materials stored in the database is determined in advance, for example, by a user or the like defining sound materials to be used for the sound generation and sound generation timing of the sound materials. Therefore, the user has to determine as many combinations of the sound materials and sound generation timing as the number of tones to be audibly generated or sounded. Thus, the longer a music piece to be created by the user setting a multiplicity of combinations of sound materials and sound generation timing, the greater would become an amount of operation to be performed by the user.

A long music piece may contain a portion where a particular sound generation style (or sound generation content) of a predetermined time period is to be repetitively audibly generated or sounded. In such a case, a user may sometimes simplify the necessary operation by copying combinations of sound materials and sound generation timing of that portion and applying the copied combinations to another time period of the music piece. However, applying such a mere copy may undesirably result in monotonousness of the music piece.

To avoid such an inconvenience, the user may sometimes attempt to change impression of the copied portion of the music piece without greatly changing a progressing flow of the music piece. In such a case, the user, in effect, changes the types of the sound materials to be sounded (i.e., target sound materials) without changing the sound generation timing. However, because there is a need to change the types of all of the target sound materials, this approach would end up failing to achieve simplification of the operation.

SUMMARY OF THE INVENTION

In view of the foregoing prior art problems, it is an object of the present invention to provide an improved technique which, in a case where tones are to be generated by combining sound materials, facilities recombination of sound materials to be used so that impression of a music piece, for example, in a partial time period of the music piece can be changed with ease.

In order to accomplish the above-mentioned object, the present invention provides an improved sound generation control apparatus, which comprises: a display control section which displays, on a display screen, an image of an icon placement region having a time axis and which displays, in the icon placement region, an icon image, with which feature amount information descriptive of a feature of material data comprising a waveform of a sound material is associated, in association with a desired time position on the time axis; a setting section which sets, in association with a desired time range on the time axis of the icon placement region, a particular database to be used, the particular database being selected from among a plurality of types of databases that store material data in association with feature amount information; and a sound generation control section which acquires, on the basis of the feature amount information associated with the icon image, the material data from the database set in association with the time range containing the time position where the icon image is placed, and which generates tone data on the basis of the acquired material data and the time position where the icon image is placed.

With the aforementioned arrangements, the present invention can change material data to be retrieved from a desired database, by changing a database, associated with or corresponding to an icon image displayed at a desired position on the time axis, over to another desired one of the plurality of types of databases without changing feature amount information, i.e. by changing only the database from one type to another (namely, changing only the database type setting). Thus, even in a case where the user does not have skillful knowledge about data structures, file structures and/or the like of the feature amount information, the present invention allows the user to readily perform recombination of sound materials to be used.

The present invention may be constructed and implemented not only as the apparatus invention discussed above but also as a method invention. Also, the present invention may be arranged and implemented as a software program for execution by a processor, such as a computer or DSP, as well as a non-transitory storage medium storing such a software program. In this case, the program may be provided to a user in the storage medium and then installed into a computer of the user, or delivered from a server apparatus to a computer of a client via a communication network and then installed into the client's computer. Further, the processor used in the present invention may comprise a dedicated processor with dedicated logic built in hardware, not to mention a computer or other general-purpose processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which:

FIGS. 6A and 6B are diagrams explanatory of an example of sequence data in the embodiment of the present invention;

FIG. 15 is a diagram showing "template 2" of FIG. 14 for use in the template sequence program in the embodiment of the present invention;

DETAILED DESCRIPTION OF THE INVENTION

<Embodiment>

<Overall Construction>

Figures 1, 3, 5:
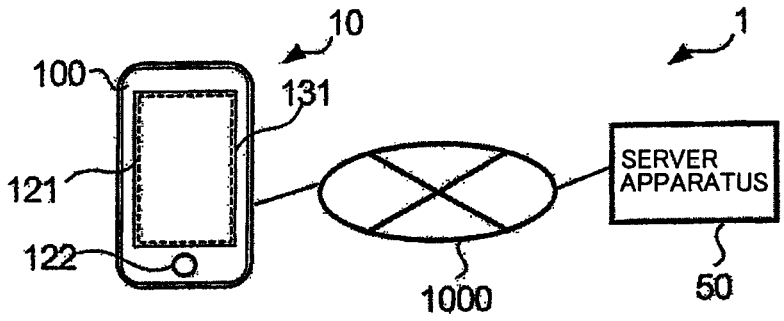
FIG. 1 is a block diagram explanatory of an overall construction of a sound generation control system according to one preferred embodiment of the present invention.
FIG. 3 is a diagram explanatory of a feature amount database (DB) in the embodiment of the present invention.
FIG. 5 is a diagram explanatory of extracted data in the embodiment of the present invention.

FIG. 1 is a block diagram explanatory of an overall construction of a sound generation control system 1 according to one preferred embodiment of the present invention. The sound generation control system 1 includes an information processing terminal 10 and a server apparatus 50 interconnected via a communication line 1000, such as the Internet. The sound generation control system 1 performs control for generating desired tones or musical sounds by combining as appropriate some of a plurality of sound materials prepared in advance. The sound materials are each in the form of a waveform that can be used as a material for creating a sound, that has a given time length, given waveform characteristic and given amplitude characteristic, and that is obtained by extracting (clipping) a partial waveform from music piece data comprising tone waveform data of a music piece performed or reproduced. Of course, sound materials may be obtained by extracting (clipping) portions of recorded waveforms of desired sounds in rather than by extracting portions of music piece data. Each of the sound materials may be in the form of a whole or part of a particular block of sound (single sound or chord) that can be recognized by a person to be a block of sound, or a phrase comprising a time-series block of a plurality of sounds, or a halfway phrase, or noise or effect sound. Note that the term "music piece data" is used herein to refer specifically to "a set of music piece waveform data". In the illustrated example, a multiplicity of material data each indicative of a waveform of a sound material are prestored in the server apparatus 50.

The information processing terminal 10 is, for example, a portable telephone, tablet terminal, or PDA (Personal Digital Assistant). As shown in FIG. 1, the information processing terminal 10 includes, on the front surface of its casing 100, a touch sensor 121, operation button 122 and a display screen 131. The touch sensor 121 is provided on the front surface of the display screen 131 to constitute a touch panel in conjunction with the display screen 131. Let it be assumed here that instructions to be given to the information processing terminal 10 are input by the user operating the touch sensor 121 or operation button 122. Although only one operation button 122 is shown in FIG. 1, a plurality of the operation buttons may be provided, or no operation button may be provided at all. The information processing terminal 10 generates sequence data for combining material data, prestored in the server apparatus 50, to sound or audibly generate tones on the basis of the combination. Further, on the basis of such sequence data, the information processing terminal 10 acquires material data from the server apparatus 50 and audibly generates, via a speaker 161 (FIG. 4), a tone on the basis of the acquired material data.

<Construction of the Server Apparatus 50>

Figure 2:
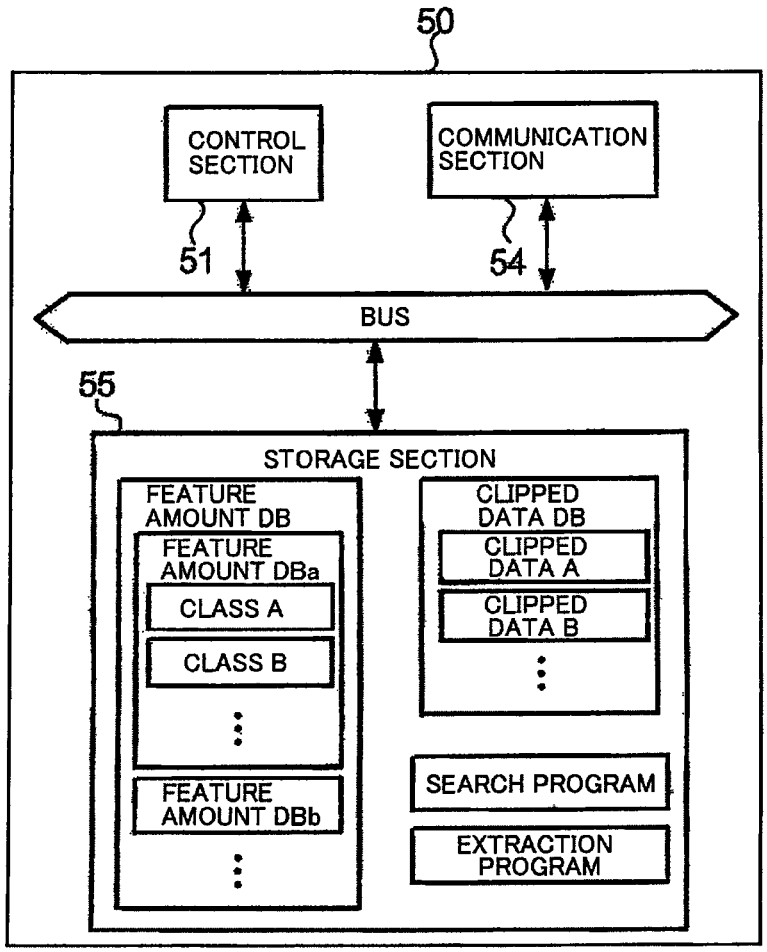
FIG. 2 is a diagram explanatory of a construction of a server apparatus in the embodiment of the present invention.

FIG. 2 is a diagram explanatory of a hardware construction of the server apparatus 50 in the embodiment of the present invention. The server apparatus 50 includes a control section 51, a communication section 54 and a storage section 55 that are interconnected via a bus.

The control section 51 includes a CPU (Central Processing Unit), a RAM (Random Access Memory), a ROM (Reed Only Memory), etc. The control section 51 performs various functions by executing various programs stored in the ROM or storage section 55. In the illustrated example, the control section 51 executes a search program or extraction program in response to an instruction given via the information processing terminal 10. Through execution of the search program, the control section 51 performs a function of searching through a feature amount database (sometimes referred to also as "feature amount DB") in response to an instruction given via the information processing terminal 10 and transmitting identified (searched-out) material data to the information processing terminal 10. The extraction program performs a function of extracting material data, which becomes a sound material, from clipped data transmitted from the information processing terminal 10 and then storing the extracted material data into the storage section 55. Details of these functions will be described later.

Under control of the control section 51, the communication section 54 is connected to the communication line 1000 to communicate information with communication devices, such as the information processing terminal 10. The control section 51 may update information, stored in the storage section 55, with information acquired via the communication section 54. The communication section 54 may include an interface connectable with external devices in a wired or wireless fashion, without being limited to performing communication via the communication line 1000.

The storage section 55, which comprises a hard disk, nonvolatile memory and/or the like, includes not only a storage area for storing the feature amount DB and a clipped data database (hereinafter referred to also as "clipped data DB") but also a storage area for storing various programs, such as the search program and extraction program.

The clipped data DB is a database for storing a multiplicity of clipped data obtained by extracting (clipping) parts of tone waveforms. Each clipped data is data a part or whole of which is used as material data indicative of a sound material.

The feature amount DB comprises a plurality of types of feature amount databases that are represented by DBa, DBb, . . . . However, the feature amount databases will be collectively referred to as "feature amount DB" when they are explained without having to be particularly distinguished from one another. The feature amount DB is prestored in the storage section 55, and any new type of feature amount DB may be acquired from an external device via the communication section 54 and then additionally stored into the storage section 55.

FIG. 3 is a diagram explanatory of an example of the feature amount DB employed in the embodiment of the present invention. The feature amount DB stores, per material data indicative of one material sound material, material identification information identifying the one sound material and feature amount information indicative of the sound material in association with each other. The feature amount DB stores such material identification information and feature amount information (more specifically, pieces of feature amount information) for a plurality of material data. A multiplicity of the material data are classified into a plurality of categories (class A, class B, . . . ) in accordance with content of the feature amount information. The material identification information comprises a combination of information identifying particular clipped data stored in the clipped data DB and information indicative of a data range designating a part or whole of the clipped data. In the illustrated example of FIG. 3, the material data corresponds to a data range from time point ts1 to time point te1 from the data head of clipped data A.

The feature amount information (each of the pieces of feature amount information) comprises a plurality of types of feature amounts p1, p2, . . . descriptive of or defining one material data corresponding thereto. The feature amounts descriptive of the material data are, for example, feature amounts of the sound material (tone waveform) represented by the material data, such as intensity of individual frequency regions (e.g., high-frequency region, medium-frequency region and low-frequency region), a time point when an amplitude peak is reached (e.g., time point from the head of the material data), peak amplitude intensity, degree of harmony, complicatedness, and the like, of the sound material which are in the form of values obtained by analyzing the material data (i.e., clipped data of the tone waveform). For example, the value of one feature amount p1 is indicative of intensity of the high-frequency region of the sound material. In the following description, a plurality of pieces of feature amount information P of individual material data are indicated by different Pa, Pb, . . . . As apparent from the foregoing, each of the plurality of different pieces of feature amount information Pa, Pb, . . . comprises a set of specific feature amounts p1, p2, . . . specific to the corresponding material data.

Note that, even for same feature amount information P, material data associated with the feature amount information P may differ among the plurality of types of feature amount databases DBa, DBb, . . . . For example, material data that are retrievable from the different feature amount databases Dba and DBb in response to access with the feature amount information P of same content are different from each other although they are similar to each other. Thus, switching can be made among the different material data by changing the feature amount database to be accessed with the feature amount information P, without the feature amount information P being changed in content.

As noted above, the material data are classified into categories or classes in accordance with the content of the feature amount information. More specifically, material data (sound materials) similar in auditory character are classified into a same category. Examples of the categories include a category (class A) into which material data are classified as sounds having a clear attack and a strong edge feeling (e.g., edge sounds), and a category (class B) into which material data are classified as sounds sounding as noise (e.g., texture sounds).

In the feature amount DB of FIG. 3, the material data identified as a data range from time point ts1 to time point te1 of clipped data A has a feature amount Pa and is classified into the category of class A. The foregoing has been a description about the hardware construction of the server apparatus 50.

<Construction of the Information Processing Terminal 10>

Figure 4:
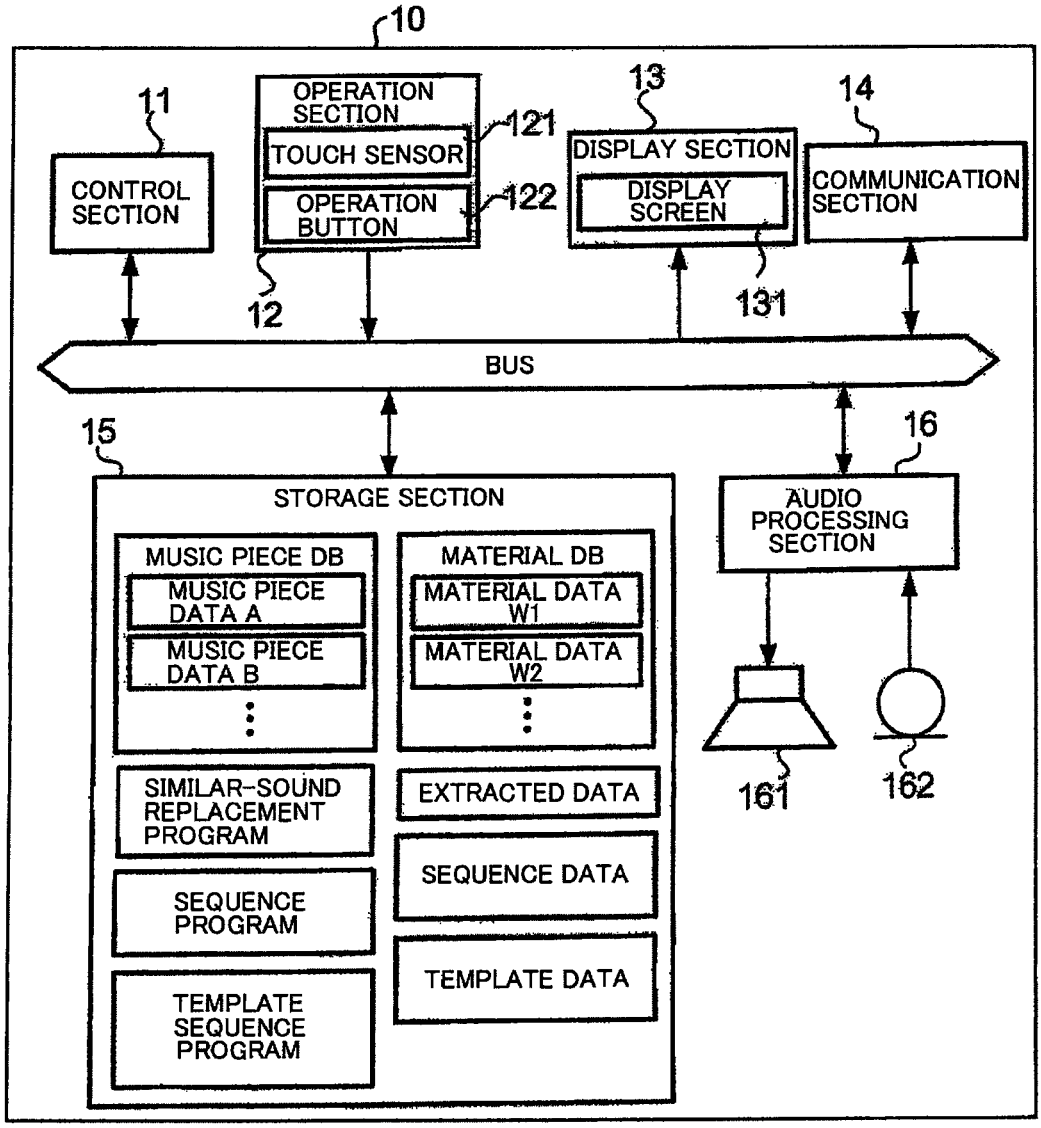
FIG. 4 is a diagram explanatory of a construction of an information processing terminal in the embodiment of the present invention.

FIG. 4 is a diagram explanatory of a hardware construction of the information processing terminal 10 in the embodiment of the present invention. The information processing terminal 10 includes a control section 11, an operation section 12, a display section 13, a communication section 14, a storage section 15 and an audio processing section 16 that are interconnected via a bus. Further, the information processing terminal 10 includes the speaker 161 and a microphone 162 connected to the audio processing section 16.

The control section 11 includes a CPU, RAM, ROM, etc, and performs various functions by executing various programs stored in the ROM or storage section 15. In the illustrated example, the control section 11 executes a sequence program, similar-sound replacement program or template sequence program in accordance with an instruction given by the user. Through execution of the sequence program, the control section performs, in accordance with an instruction input by the user, a function of generating sequence data for combining material data to audibly generate tones on the basis of the combined material data and acquires material data searched out and identified by the server apparatus 50 to audibly generate the material data through the speaker 161. The similar-sound replacement program performs a function of causing the server apparatus 50 to extract desired material data, which becomes a sound material, for example from music piece data prepared in advance, acquiring, form the database, material data similar in feature amount information to the extracted material data and replacing the extracted material data of the music piece data with the acquired similar material data to thereby modify the music piece data so that the modified music piece data is audibly generated through the speaker 161. The template sequence data performs a function of audibly generating material data, similar in feature amount information to the extracted material data, in accordance with a template. Details of such functions will be described later.

The operation section 12 includes a touch sensor 121 and an operation button 122 via which the user performs desired operation (i.e., which receives desired operation by the user), and it outputs, to the control section 11, operation information indicative of content of the received user's operation. Thus, the user's instruction is input to the information processing terminal 10.

The display section 13, which is a display device, such as a liquid crystal display, displays various content, corresponding to control performed by the control section 11, on a display screen 131. Namely, various content, such as a menu screen, setting screen etc., are displayed on the display screen 131 depending on the executed programs (see FIGS. 8, 11, 12, 13 and 14).

Under control of the control section 11, the communication section 14 is connected to the communication line 1000 to communicate information with a communication device, such as the server apparatus 50. The control section 14 may update information stored in the storage section 15 with information acquired via the communication line 1000. Further, the communication section 14 may include an interface connectable with external devices in a wired or wireless fashion, without being limited to performing communication via the communication line 1000.

The storage section 15 includes a temporary storage area in the form of a volatile memory, and a non-volatile memory. Music piece data to be used in a later-described program, a program to be executed, etc. are temporarily stored in the temporary storage area. The non-volatile memory includes storage areas storing a music piece database (hereinafter referred to also as "music piece DB"), extracted data, material database (hereinafter referred to also as "material DB"), sequence data and template data, and a storage area storing various programs, such as the above-mentioned sequence program, similar-sound replacement program and template sequence program. Although the various data stored in the non-volatile memory are prestored in the storage section 15, other data may be acquired from an external device via the communication section 14 and additionally stored into the non-volatile memory. Further, new sequence data and template data created by the user in a later-described manner may also be stored into the storage section 15.

The music piece DB is a database having stored therein music piece data (music piece data A, music piece data B, . . . ) indicative of waveforms of various music pieces. The material DB is a database having stored therein replacing material data (material data W1, material data W2, . . . ) transmitted from the server apparatus 50 as a result of the server apparatus 50 executing the search program in the server apparatus 50.

FIG. 5 is a diagram explanatory of extracted data in the embodiment of the present invention. The extracted data include material identification information identifying material data extracted from music piece data in the server apparatus 50, feature amount information of the material data, a class determined in accordance with the feature amount information, and information indicative of replacing material data identified in the server apparatus 50 to be similar to the feature amount information of the extracted material data, and these information and class are stored in association with one another. Similarly to the above-mentioned material identification information stored in the feature amount DB, the material identification information of the extracted material data comprises a combination of information identifying music piece data and information indicative of a data range designating a part or whole of the music piece data. In the illustrated example of FIG. 5, the extracted material data corresponds to a data range from time point ts2 to time point te2 from the data head of music piece data A, whose feature amount is indicated by Pb, category is class B and replacing material data similar to the extracted material data are indicated by W5, WE1, W2, . . . in descending order of similarities to the extracted material data.

FIGS. 6A and 6B are diagrams explanatory of an example of sequence data in the embodiment of the present invention. The sequence data comprises feature amount designating data (FIG. 6A) and DB designating data (FIG. 6B). The feature amount designating data comprises reproduction time points each indicative of sound generation timing, feature amount information each corresponding to material data to be sounded at the sound generation timing and sound volumes each indicative of a volume with which corresponding material data is to be sounded, and corresponding ones of the reproduction time points, feature amount information and sound volumes are stored in association with one another. The illustrated example of FIG. 6A indicates that a sound based on the feature amount information Pb is sounded at reproduction time point "0002: 01: 000" (corresponding to a first beat of a second measure) with sound volume "20". As will be later described, the sound based on the feature amount information Pb is not necessarily limited to a sound based on the sound material indicated by the material data of the feature amount information Pb and can be any one of sounds similar to that sound based on the material data.

The DB designating data is data designating or setting, for a given reproduction time range, a desired type of feature amount DB which should become an object of search (i.e., search-target feature amount DB) through which the server apparatus 50 searches to identify material data. More specifically, in the illustrated example of FIG. 6B, the search-target feature amount DB to be set for a reproduction time range from "0001: 01: 000" to "0001: 03: 959" is a feature amount database DBa. The template data will be described later.

Referring back to FIG. 4, a sound generated by the user is input to the microphone 162 that outputs an audio signal, indicative of the user-generated sound, to the audio processing section 16. The speaker 161 sounds or audibly generates an audio signal output from the audio processing section 16. The audio processing section 16 includes, among others, a signal processing circuit, such as a DSP (Digital Signal Processor). The audio processing section 16 performs analog-to-digital (A/D) conversion on the audio signal input from the microphone 162 and outputs the resultant converted audio signal to the control section 11. Further, the audio processing section 16 performs signal processing set by the control section 11, such as effect processing, digital-to-analog (D/A) conversion processing, amplification processing etc., on tone data output from the control section 11, and then the audio processing section 16 outputs the resultant processed tone data to the speaker 161 as an audio signal. The foregoing has been a description about the hardware construction of the information processing terminal 10.

<Functional Arrangements>

The following describe functions implemented by the control section 11 of the information processing terminal 10 executing the sequence program and the control section 51 of the server apparatus 50 executing the search program in response to the execution, by the control section 11, of the sequence program. Note that one or some or all of arrangements for implementing the following functions may be implemented by hardware.

Figure 7:
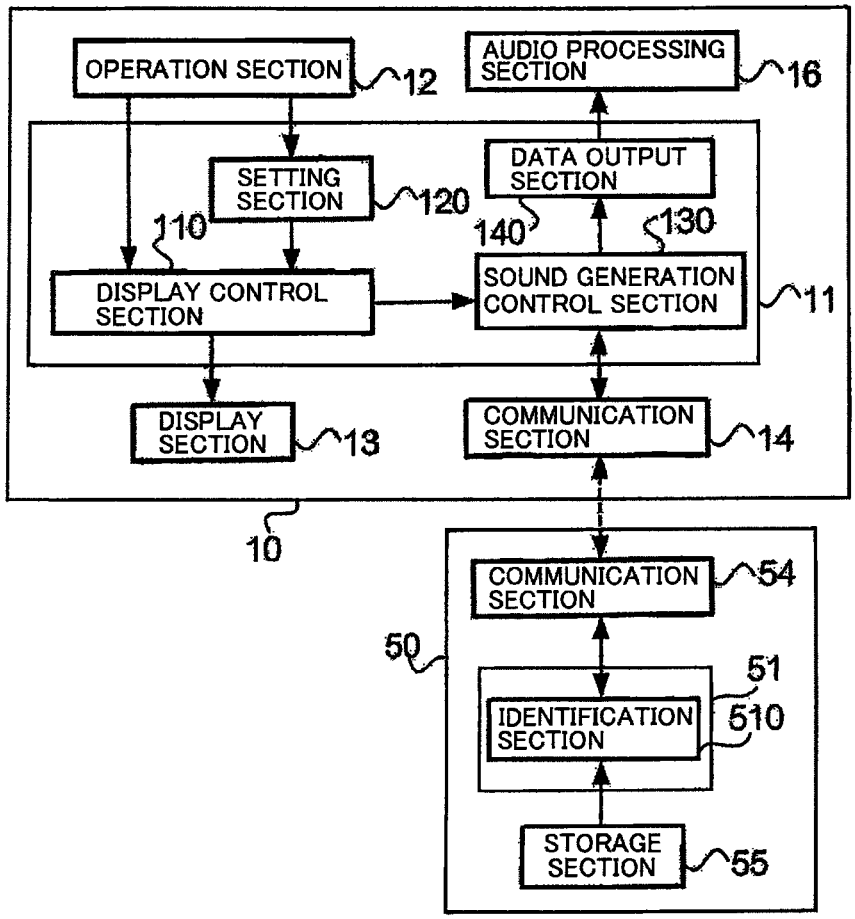
FIG. 7 is a functional block explanatory of functions of the information processing terminal and server apparatus in the embodiment of the present invention.

FIG. 7 is a functional block explanatory of functions of the information processing terminal 10 and server apparatus 50 in the embodiment of the present invention. In response to the control section 11 starting the execution of the sequence program, a display control section 110, setting section 120, sound generation control section 130 and data output section 140 are built, so that the information processing terminal 10 functions as a sound generation control apparatus. Further, in response to the control section 51 starting the execution of the search program, an identification section 510 is built, so that the server section 50 functions as an identification apparatus.

In response to an instruction input by the user, the display control section 110 controls displayed content on the display screen 131. In this case, content as shown in FIG. 8 is displayed on the display screen 131.

Figure 8:
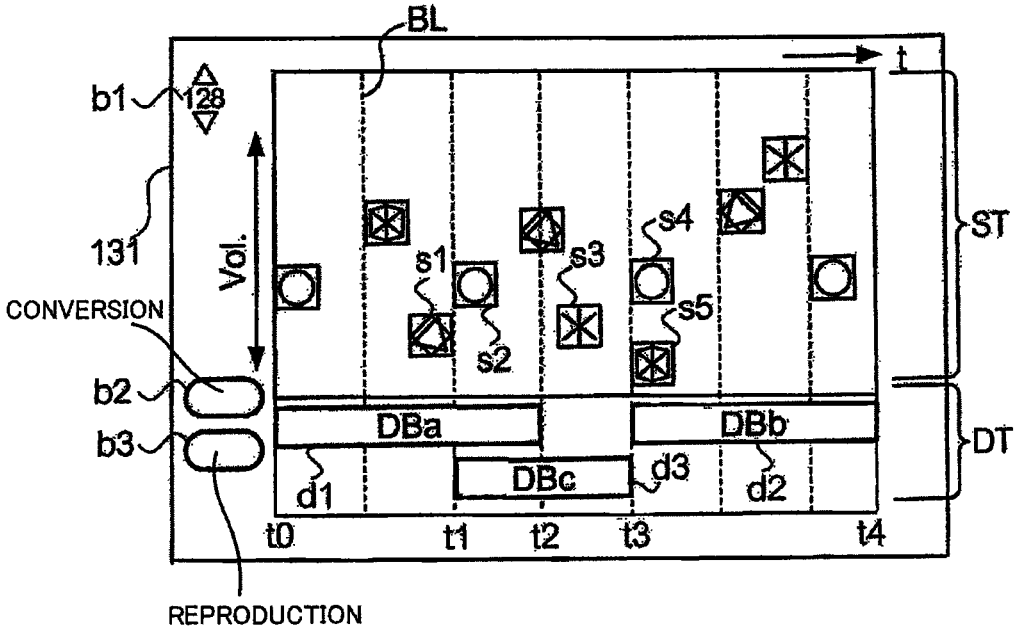
FIG. 8 is a diagram explanatory of an example display presented on a display screen during execution of a sequence program in the embodiment of the invention.

FIG. 8 is a diagram explanatory of an example display presented on the display screen 131 during execution of the sequence program in the embodiment of the invention. The display screen 131 includes two major regions: an icon placement region ST; and a DB placement region DT. The icon placement region ST and the DB placement region DT have their respective horizontal axes set as a common time axis. Bar lines BL are each an auxiliary line indicating one beat position. Further, the icon placement region ST has a vertical axis set as a sound volume axis defining sound volumes. However, such a sound volume axis may be dispensed with if sound volumes are defined irrespective of positions of icon images.

Icon images s1, s2, . . . are images which various feature amount information is associated with. With the icon images s1, s2, . . . displayed or placed in the icon placement region ST, sound generation timing of a sound based on the feature amount information corresponding to any one of the icon images is defined in accordance with a position along the time axis (i.e., time-axial position) of the left end of the icon image. Further, a sound volume is defined in accordance with a position, along the sound volume axis, of the lower end of the icon image. Types of designs of the individual icon images s1, s2, . . . are determined so as to differ depending on the categories (class A, class B, . . . ) which the various feature amount information associated with, or corresponding to, the icon images is classified into. For example, the feature amount information corresponding to the icon image s1 and the feature amount information corresponding to the icon image s2 is classified into different categories, but the feature amount information corresponding to the icon image s2 and the feature amount information corresponding to the icon image s4 is classified into a same category. Note, however, that the icon images need not necessarily differ in design depending on the categories; namely, all of the icon images may be of a same design. Alternatively, the icon images may be controlled to differ in design from one another in accordance with another parameter than the category.

DB images d1, d2, . . . are each an image indicative of a time range, designatable as desired, with which a desired type of feature amount DB can be associated. Each of such time ranges can be set at and changed to a desired position and length in response to user's operation or in accordance with sequence data or the like. Such DB images d1, d2, . . . are displayed or placed in the DB placement region DT, and a time period (time range) in which the feature amount DB corresponding to any one of the DB images is to be applied as an object of search (search-target feature amount DB) by the server apparatus 50 is defined in accordance with a time axial (left-end-to-right-end) position of the DB image. For example, a range from time point t0 to time point t2 is defined as a time range in which the feature amount database DBa is to be applied as a search-target feature amount DB, and a range from time point t1 to time point t3 is defined as a time range in which the feature amount database DBc is to be applied as a search-target feature amount DB. Namely, in the range from time point t0 to time point t2, both the feature amount database DBa and the feature amount database DBc are applied as the search target feature amount database.

Further, on the display screen 131 are displayed: tempo control buttons b1 for setting a reproduction tempo; a conversion instruction button b2 for instructing conversion from sequence data into tone data on the basis of a placement style of an icon image in the icon placement region; and a reproduction instruction button b3 for sounding or audibly generating the converted tone data. Note that a storage button for causing created sequence data to be stored into the storage section 15, and the like, may also be displayed.

Referring back to FIG. 7, the setting section 120 of the information processing terminal 10 sets a particular type of feature amount DB along the time axis in accordance with an instruction input by the user. In the illustrated example, the setting section 120 outputs the thus-set feature amount DB type (i.e., feature amount DB type setting) to the display control section 110, so that the corresponding DB image (indicative of the set feature amount DB type) is displayed on the display screen 131 as shown in FIG. 8. The setting section 120 need not necessarily output the set feature amount DB type to the display control section 110, in which case the corresponding DB image is not placed on the display screen 131 and thus the DB placement region DT may be dispensed with. Namely, the set feature amount DB type may or need not be placed on the display screen 131 as along as the type of the feature amount DB is set along the same time axis as the icon placement region ST.

The display control section 110 and the setting section 120 generate sequence data in accordance with an icon image placement style and a feature amount DB type setting style. Here, the display control section 110 generates feature amount designating data of the sequence data, while the setting section 120 generates DB designating data of the sequence data. Content of the sequence data may be determined each time an icon image is placed or a feature amount DB is set, or when the conversion instruction button b2 is operated. Once the above-mentioned storage button is operated by the user while the storage button is displayed on the display screen 131, the sequence data generated as above is stored into the storage section 15.

Once the conversion instruction button b2 is operated by the user, the sound generation control section 130 transmits a part or whole of the generated sequence data to the server apparatus 50 via the communication section 14, so that the control section 51 of the server apparatus 50 activates and executes the search program. The "part of the sequence data" means data in which at least feature amount information and a type of feature amount DB having correspondence relationship in time axis with the feature amount information (type information) are associated with each other. Then, the sound generation control section 130 receives material data from the server apparatus 50 via the communication section 14 and outputs tone data by means of the data output section 140 on the basis of the received material data and sequence data. More specifically, the sound generation control section 130 processes, i.e. changes the level of, the material data, corresponding to one of the icon images, in accordance with a sound volume with reference to feature amount designating data of the sequence data, and causes the processed material data to be output, as tone data at timing corresponding to a reproduction time point, via the data output section 140 that outputs the tone data under control of the sound generation control section 130.

The identification section 510 receives, via the communication section 54, information based on the sequence data transmitted from the sound generation control section 130, searches for a feature amount DB of a type (search-target type) indicated by the received information, and identifies, for each of the feature amount information included in the sequence data, material data having feature amount information matching (or identical to or similar to) that feature amount information included in the sequence data. In the illustrated example, the identification section 510 handles the feature amount information as a vector amount composed of a plurality of feature amounts and references a feature amount DB of a search-target type to identify material data having feature amount information that has the smallest Euclidian distance.

Note that any other conventionally-known algorithm than the aforementioned may be employed for determining a similarity (matching degree). As another alternative, the identification section 510 may identify material data whose feature amount information has the second or third smallest Euclidian distance rather than the smallest Euclidian distance, i.e. whose feature amount information is the second or third closest to the feature amount information included in the sequence data. Information necessary for such identification may be set in advance by the user or the like. Further, the material data to be identified need not necessarily be similar in feature amount information to the feature amount information included in the sequence data as long as it is in particular predetermined relationship with the feature amount information included in the sequence data. The search target may be further narrowed down by the category rather than being limited to the search-target feature amount DB. In such a case, the category that becomes a search target may be designated for example by the user, or may be a same category as, or a related category to, the feature amount information included in the sequence data. Here, the "related category" may be determined by a preset algorithm, or mutually-related categories may be set in advance.

Then, the identification section 510 transmits the identified material data to the sound generation control section 130 via the communication section 54. In the illustrated example, as seen from the above, the communication section 54 functions as an acquisition means for acquiring information based on the sequence data by the information through communication means, and as an output means for outputting the identified material data by transmitting the identified material data through the communication means.

The foregoing has been a description about the functional arrangements of the information processing terminal 10 and server apparatus 50. The following describe, with reference to FIG. 9, behavior of the sound generation control system 1 during execution of the sequence program.

<Behavior During Execution of the Sequence Program>

Figure 9:
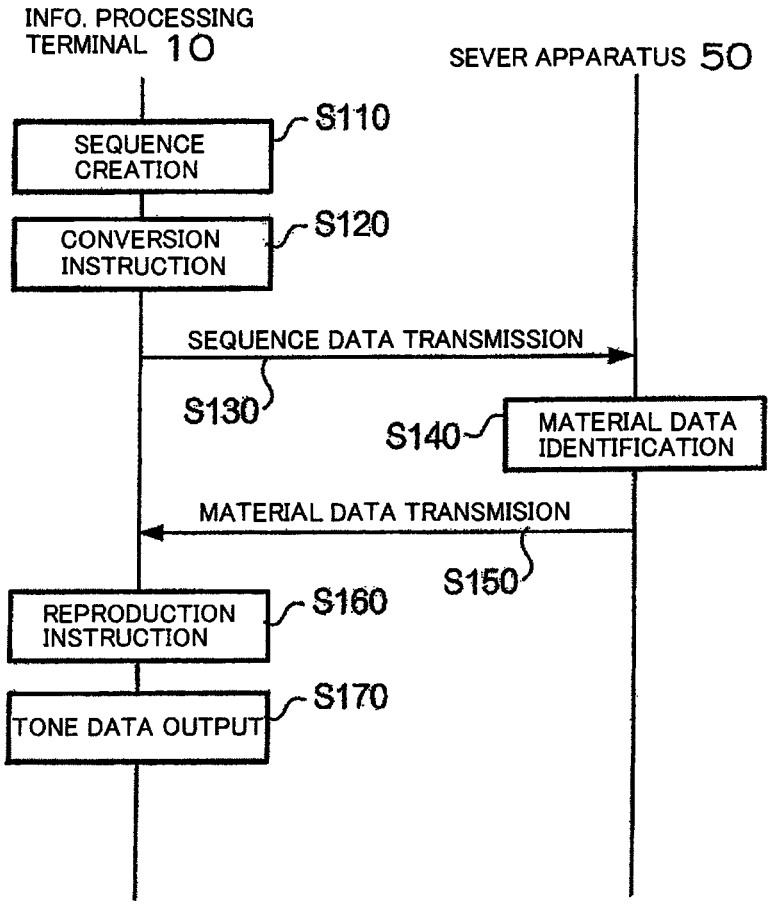
FIG. 9 is a diagram explanatory of behavior of the sound generation control system during execution of the sequence program in the embodiment of the present invention.

FIG. 9 is a diagram explanatory of behavior of the sound generation control system 1 during execution of the sequence program in the embodiment of the present invention. Here, the behavior of the sound generation control system 1 after the user inputs an instruction for executing the sequence program to the information processing terminal 10 will be described with primary reference to FIG. 9. Upon startup of the sequence program, the icon placement region ST, DB placement region DT, etc. are displayed on the display screen 131 as shown in FIG. 8. Let it be assumed that no icon image and DB image are displayed yet on the display screen 131 at this stage.

A sequence for generating tones is created at step S110 in response to the user inputting an instruction for determining content of feature amount information, an instruction for displaying or placing, in the icon placement region ST, icon images of designs depending on the determined content, and an instruction for displaying or placing DB images in the DB placement region DT. As a consequence, the content shown in FIG. 8 is displayed on the display screen 131. Sequence data generated in this state is, for example, of content shown in FIGS. 6A and 6B, in which case feature amount information Pc, Pd and Pe corresponds to icon images s3, s4 and s5, respectively.

Once the user inputs a conversion instruction by operating the conversion instruction button b2 at step S120, the sound generation control section 130 of the information processing terminal 10 transmits the sequence data to the server apparatus 50 at step S130. The sequence data to be transmitted here need not include all of predetermined information as long as it includes data having a portion where the feature amount information and types of feature amount DBs having predetermined correspondence relationship in time axis with the feature amount information are associated with each other.

Upon receipt of the sequence data from the information processing terminal 10, the server apparatus 50 executes the search program so that the identification section 510 searches through the feature amount DB to identify material data at step S140. For example, for the feature amount information Pc corresponding to the icon image s3, the identification section 510 searches through the feature amount database DBc of a particular type having predetermined correspondence relationship in time axis with the feature amount information Pc, retrieves material data identified as having feature amount information similar to the feature amount information Pc and transmits the retrieved material data to the information processing terminal 10 at step S150. At that time, the server apparatus 50 transmits the identified material data in such a manner as to permit identification as to which of the feature amount information the identified material data corresponds to.

Upon completion of the receipt of the material data, the information processing terminal 10 informs the user to that effect. Then, once the user input a reproduction instruction by operating the reproduction instruction button b3 at step S160, the sound generation control section 130 controls the data output section 140. The sound generation control section 130 adjusts the sound volume of the received material data with reference to feature amount designating data of the sequence data and causes the volume-adjusted material data to be output as tone data in accordance with a reproduction time point of the corresponding feature amount information (step S170), so that the material data is sounded or audibly generated through the speaker 161.

In the aforementioned manner, tone data are output from the information processing terminal 10 in accordance with the user-created sequence. Note that the type of feature amount DB that becomes a search target (search-target feature amount DB type) is defined by the DB designating data. Therefore, the search-target feature amount DB type can be changed to another by the user only changing the DB designating data, and thus, in this case, even when the feature amount designating data is not changed in content, the material data identified by the identification section 51 too changes; accordingly, content to be audibly generated in accordance with the user's reproduction instruction too changes. At that time, even if one material data changes to another, the feature amount information does not necessarily change, and thus, in most cases, material data can be identified, staring with material data classified into the same category as the feature amount information, without the sound of the material data changing to a completely different sound. Therefore, in the case where the types of feature amount DBs correspond to genres (jazz, rock, etc.), it is possible to change an impression of generated tones or sounds, for example, to a jazz-like or rock-like impression, by the user only changing the DB designating data while maintaining the same sound generation style or content (e.g., pattern of tones).

Figure 10:
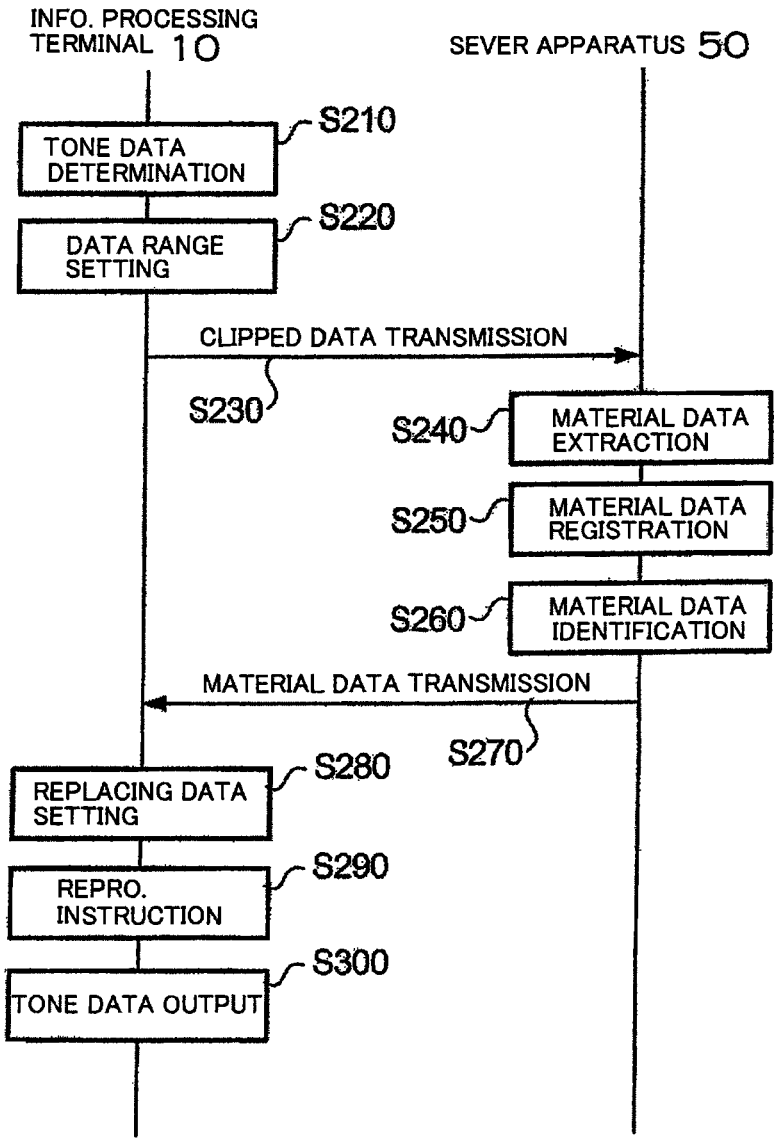
FIG. 10 is a diagram explanatory of behavior of the sound generation control system during execution of a similar-sound replacement program in the embodiment of the present invention.

The following describe, with reference to FIG. 10, behavior of the sound generation control system 1 during execution of the similar-sound replacement program.

<Behavior During Execution of the Similar-Sound Replacement Program>

Figure 11A:
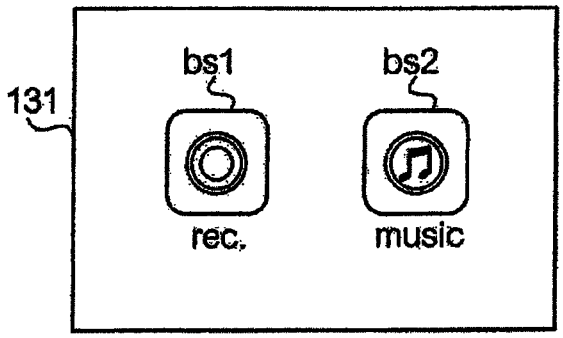
FIGS. 11A to 11C are diagrams explanatory of example displays presented on the display screen during execution of the similar-sound replacement program in the embodiment of the present invention.
Figure 11B:
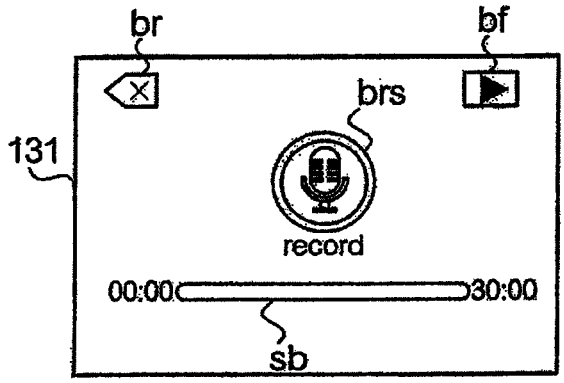
Figure 11C:
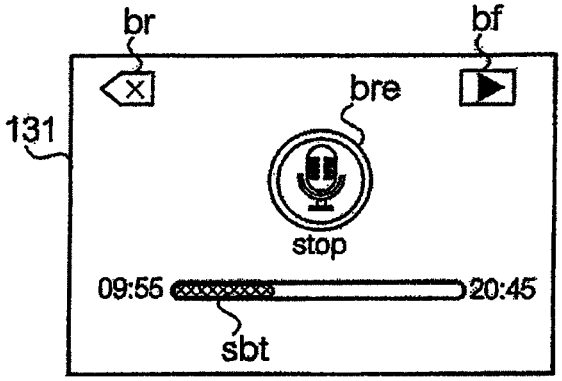

FIG. 10 is a diagram explanatory of behavior of the sound generation control system 1 during execution of the similar-sound replacement program in the embodiment of the present invention. Here, the behavior of the sound generation control system 1 after the user inputs an instruction for executing the similar-sound replacement program to the information processing terminal 10 will be described with primary reference to FIG. 10. Upon startup of the similar-sound replacement program, content shown in FIGS. 11A to 11C is displayed on the display screen 131 as a display for determining tone data including clipped data that is to be transmitted to the server apparatus 50 for extraction therefrom material data. The control section 11 determines, at step S210, tone data in accordance with an instruction input by the user.

FIGS. 11A to 11C are diagrams explanatory of example displays presented on the display screen 131 during execution of the similar-sound replacement program in the embodiment of the present invention. Upon startup of the similar-sound replacement program, the control section 11 displays, on the display screen 131, a screen for determining whether tone data is to be recorded and input or tone data is to be selected from music piece data prestored in the music piece DB of the storage section 15. In the illustrated example, a recording selection button bs1 for instructing that tone data be recorded and input and a music piece data selection button bs2 for instructing that tone data be selected from music piece data are displayed on the display screen 131 as shown in FIG. 11A.

Once the user operates the music piece data selection button bs2, the control section 11 displays, on the display screen 131, a list of music piece data (i.e., music piece data sets) stored in the music piece DB, although not particularly shown. Then, once the user inputs an instruction for selecting one music piece data (music piece data set) from the list, the control section 11 determines the selected music piece data as tone data (see step S210 of FIG. 10).

On the other hand, once the user operates the recording selection button bs1, the control section 11 switches the content displayed on the display screen 131 to the content shown in FIG. 11B. At that time, a recording start button brs for receiving a user's instruction for starting recording (i.e., operable by the user to input an instruction for starting recording), a recording time display bar region sb indicative of a time elapsed from the start of the recording, a return button br for receiving a user's instruction for returning to a last (i.e., immediately preceding) screen (in this case, the screen shown in FIG. 11A) and an enter button bf for receiving a user's instruction for determining recorded content as tone data are displayed on the display screen 131.

Once the user operates the recording start button brs, the control section 11 switches the content displayed on the display screen 131 to the content shown in FIG. 11C and accumulates data indicative of sounds input via the microphone 162. At that time, on the display screen 131, the recording start button brs is changed to a recording stop button bre for receiving a user's instruction for stopping the recording, and an elapsed time display bar sbt is displayed in the recording time display bar region sb.

In this state, the user inputs, via the microphone 162, sounds to be set as tone data. Once the user operates the recording stop button bre after termination of the sound input, the control section 11 terminates the accumulation of the data indicative of the sounds input via the microphone 162 and then switches the content displayed on the display screen 131 to the content shown in FIG. 11B.

Then, once the user operates again the recording start button brs, the control section 11 starts again the recording, in which case it starts accumulation of new data indicative of sounds either after discarding the so-far accumulated data or without discarding the so-far accumulated data. Once the user operates the enter button bf, on the other hand, the control section 11 determines the data, so far accumulated by the recording, as tone data (see step S210 of FIG. 10).

Figure 12:
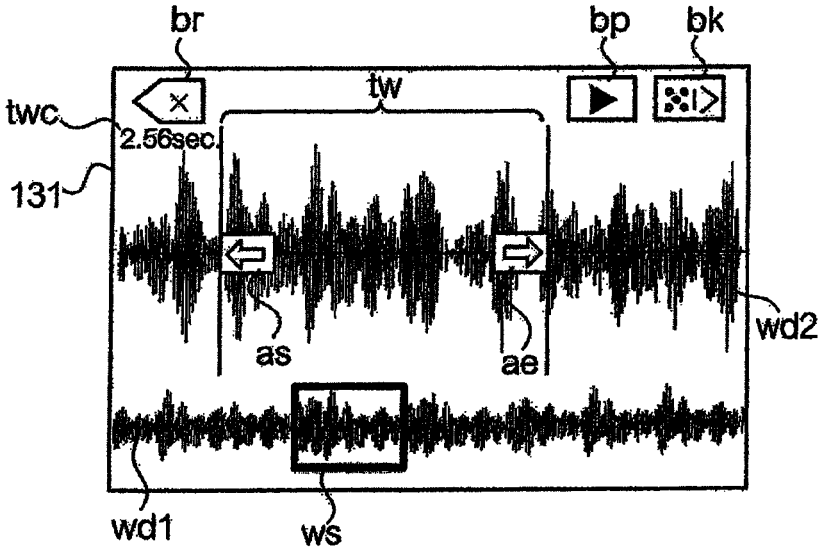
FIG. 12 is a diagram explanatory of a screen for setting a material data range during execution of the similar-sound replacement program in the embodiment of the present invention.

The control section 11 determines, as tone data, the music piece data or the data accumulated by the recording (step S210) in the aforementioned manner and then switches the content displayed on the display screen 131 to content shown in FIG. 12.

FIG. 12 is a diagram explanatory of a screen for setting a material data range during execution of the similar-sound replacement program in the embodiment of the present invention. In this example, a waveform wd2, which is a portion of a waveform wd1 of determined tone data, is displayed in an enlarged scale on the display screen 131. A display range window ws for defining a display range of the partial waveform wd2 of the waveform wd1 is also displayed on the display screen 131. Once the user inputs an instruction for changing a position and range of the display range window ws, the control section 11 not only changes the position and range of the display range window ws but also changes the display of the waveform wd2 in accordance with the changed position and range change of the display range window ws.

On the display screen 131 are also displayed range designating arrows (start designating arrow "as" and end designating arrow "ae") for designating a data range (clipped data range) tw to be transmitted to the server apparatus 50. Once the user designates positions of the range designating arrows, a range between the designated positions is designated as the data range tw. A time display twc is indicative of a time of the data range tw. The ranges may be designated in any other suitable manners than the aforementioned; for example, the number of beats and times may be input in numerical values by some input means.

On the display screen 131 are also displayed a setting button bk for setting the designated data range tw, a return button br for receiving a user's instruction for returning to a last (immediately preceding) screen and a reproduction button by for receiving a user's instruction for reproducing the tone data of the designated data range tw so that the tone data is output through the speaker 161. The above-mentioned position may be designated, for example, by the user touching the range designating arrows with two fingers and spreading out, narrowing and/or sliding the two fingers on the display screen 131. The range designating arrows may be displayed in a superposed relation to the waveform wd2, more specifically on or near the centerline of the waveform wd2. With the range designating arrows displayed in a superposed relation to the waveform wd2 like this, the start designating point and the end designating point can be readily identified intuitively; thus, each of the range designating arrows need not necessarily be an arrow icon and may be any desired icon that visually indicates where to touch. Further, the range designating arrows may be partly transparent or semitransparent (translucent) in such a manner that the start designating point and end designating point of the waveform can be identified with ease.

Once the user operates the reproduction button by after designating a data range tw, the control section 11 reproduces only tone data of the designated data range tw so that the tone data of the designated data range tw is reproduced to be audibly output via the speaker 161. If the user operates the setting button bk after designating a data range tw, then the control section 11 sets the data range tw as an object of material data extraction by the server apparatus 50 (step S220 of FIG. 10), so that clipped data that is tone data of the data range tw is transmitted via the communication section 14 (step S230).

Note that the DB designating data used during execution of the sequence program may be used in the similar-sound replacement program too. In such a case, the DB designating data too is transmitted to the server apparatus 50.

Once the server apparatus 50 receives the clipped data, the control section 51 of the server apparatus 50 executes the extraction program to extract material data from the tone data of the data range tw (step S240). As one example method of extracting the material data, an On-set point where a sound volume varies by more than a predetermined amount may be detected from the clipped data, and a portion that is located within a predetermined time range from the detected On-set point and that has a feature amount satisfying a particular condition may be extracted as the material data. Although any one of the conventionally-known methods may be used for extracting the material data from the clipped data indicative of tones, it is preferable to use the method disclosed in Japanese Patent Application Laid-open Publication No. 2010-191337.

Then, the control section 51 registers, into the storage section 55, data related to the extracted material data (step S250). More specifically, the control section 51 registers the received clipped data into the clipped data DB and registers the data range, feature amount information and its class into the feature amount DB. Which one or ones of the types of feature amount DBs the data range, feature amount information and its class should be registered into may be designated in advance by the user. If the clipped data is a part of music piece data and a genre corresponding to the music piece data is acquirable, the clipped data may be associated with the genre.

Registration of material data at step S260 may be dispensed with, and whether the registration of material data should be performed or not may be designated in advance by the user.

Then, the control section 51 executes the search program to identify material data similar in feature amount information to individual material data extracted from the clipped data (step S260). More specifically, in the illustrated example, the control section 51 calculates, for each of the material data extracted from the clipped data, feature amounts and searches for and identifies five material data, similar in feature amount information to the extracted material data, from the feature amount DB. The material data identification may be performed here in the same manner as performed in the identification section 510. Namely, the control section 51 may identify, for each of the extracted material data, five material data with closest feature amount information to the feature amount information of the extracted material data, i.e. in descending order of Euclidian distances from the feature amount information of the extracted material data. Note that the information registered at step S250 is excluded from a search range.

Once the control section 51 identifies the five material data similar in feature amount information to the extracted material data in the aforementioned manner, it transmits not only these five material data but also information for forming extracted data as shown in FIG. 5, such as a portion of the clipped data extracted as material data, feature amount information of the material data and information for distinguishing among the similar material data (replacing material data), to the information processing terminal 10 via the communication section 54.

If DB designating data has been received from the information processing terminal 10, the control section 51 of the server apparatus 50 determines, on the basis of the received DB designating data, a type of feature amount DB that becomes a search target at the time of identifying material data, in the same manner as in the search program executed in the server apparatus 50 in response to execution of the sequence program. At that time, such a type of feature amount DB may be determined on the basis of a data position, in the clipped data, of the extracted material data. For example, a reproduction time range in the DB designating data may be designated using information indicative of a data position of the clipped data.

Figure 13:
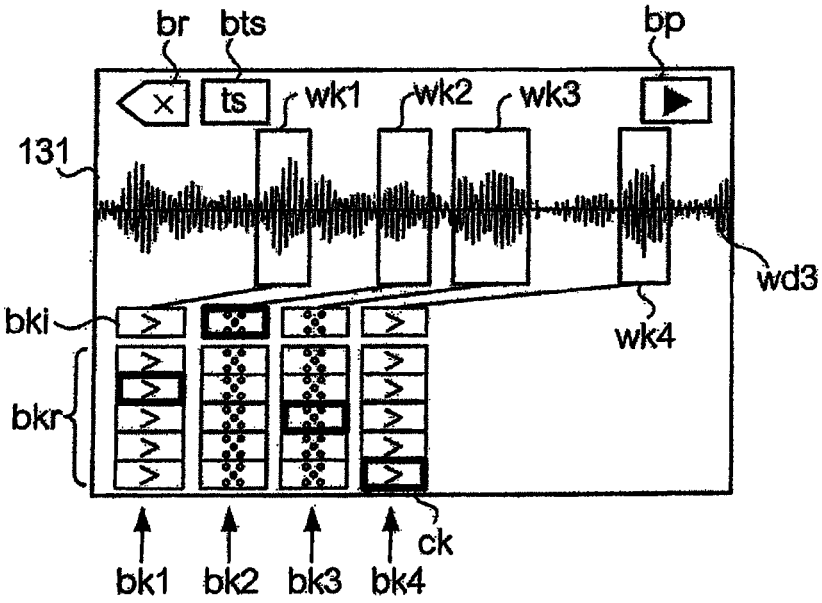
FIG. 13 is a diagram explanatory of a screen for setting a material data replacement style during execution of the similar-sound replacement program in the embodiment of the present invention.

Once the information processing terminal 10 receives these information, the control section 11 of the information processing terminal 10 stores the extracted data into a temporary storage area of the storage section 15 and displays, on the display screen 131, content as shown in FIG. 13. Note that, while processing is being performed in the server apparatus 50, i.e., while the operations at steps S230 to S270 are being performed, the control section 11 may display other content, such as a message "data being transmitted" or "data being processed", on the display screen 131.

FIG. 13 is a diagram explanatory of a screen for setting a material data replacement style during execution of the similar-sound replacement program in the embodiment of the present invention. A waveform wd3 indicative of a waveform w3 of clipped data and extraction windows wk1, wk2, . . . indicative of portions extracted as material data are displayed on the display screen 131 as shown in FIG. 13. Icon trains bk1, bk2, . . . corresponding to the extraction windows wk1, wk2, . . . are also displayed on the display screen 131 below the waveform wd3. A region of the display screen 131 in which these waveform, windows and icon trains are displayed corresponds to the above-mentioned icon placement region ST. Because a horizontal axis direction in FIG. 13 corresponds to positional relationship among materials extracted from the waveform wd3, it corresponds to the time axis as in the icon placement region ST. However, unlike in the illustrated example of FIG. 8, the waveform wd3 does not progress by a predetermined amount as a predetermined time elapses in the time axis direction. Namely, in the illustrated example of FIG. 13, the time axis of the waveform wd3, which progresses by a predetermined amount as a predetermined time elapses in the time axis direction, is expanded (stretched) or contracted as appropriate, as a consequence of which material data are displayed in a time series. Namely, the region corresponding to the icon placement region ST is sometimes displayed with the time axis expanded or contracted as appropriate. Note that, in the case where DB designating data is used, a region corresponding to the DB placement region DT may or need not be displayed on the display screen 131.

The icon trains bk1, bk2, . . . are each in the form of a row of images of a design corresponding to a category into which the material data is classified in accordance with its feature amount information. Namely, each of the images corresponds to an icon image with which the feature amount information is associated. Although the image designs may be other than those shown in FIG. 13, it is preferable that image designs permitting visual distinction among the categories be used. In the illustrated example of FIG. 13, the material data corresponding to the extraction window wk1 and the material data corresponding to the extraction window wk4 are classified into a same category, and the material data corresponding to the extraction window wk2 and the material data corresponding to the extraction window wk3 are classified into a same category.

Further, the icon trains bk1, bk2, . . . include an original sound material row bki in which icon images indicative of extracted material data are arranged, and similar sound material rows bkr in which icon images indicative of replacing material data are arranged. In the similar sound material rows bkr of FIG. 13, the icon images of material data are displayed in an up-to-down direction in descending order of similarities of material data to the corresponding material data (identifying coordinate axis in later-described modification 3). Further, the icon images of material data more similar to the corresponding material data are displayed in darker color. Note that the number of the icon image rows in the similar sound material rows bkr is not limited to the one shown in FIG. 13 and any desired number of the icon image rows may be set. Further, the way of displaying a similarity in each of the icon image is not limited to a difference in darkness of a color and may be any other suitable one, such as a difference in color, a difference in image size or the like, as long as it permits clear visual distinction among various similarities. Furthermore, a cursor ck for designating replacing material data that should replace the extracted material data is displayed in each of the icon trains bk1, bk2, . . . . Therefore, the number of the icon trains changes in accordance with the number of the extracted material data. A displayed size of each of the icons in the icon trains may be chosen in accordance with the icon trains. For example, the display screen may be allocated in advance in accordance with a greatest possible number of icon trains in such a manner that relatively great non-icon-displayed portions may be left on the display screen if the number of icon trains is relatively small, or alternatively, each time the icon trains are to be displayed, the display screen may be allocated in accordance with the number of icon trains so that the displayed size is changeable icon by icon and that the icon trains are displayed on a substantially entire area of the display screen.

Once the user inputs an instruction for designating a position on any one of the icon trains bk1, bk2, . . . shown in FIG. 13, for example, by operating any one of the cursor ck to point to the position, the control section 11 of the information processing terminal 10 makes a replacement setting for replacing the extracted material data with the replacing material data corresponding to the position of the operated cursor ck (step S280 of FIG. 10).

Further, once the user instructs reproduction by operating the reproduction button by (step S290 of FIG. 10), the control section 11 replaces the extracted data of the clipped data with the replacing material data to modify the extracted data in accordance with the replacement setting and reproduces and outputs the replaced or modified extracted data as tone data (step S300), so that the tone data is sounded or audibly generated through the speaker 161. Then, the control section 11 stores information, indicative of the modified extracted data, into the storage section 16, designating a file name in accordance with an instruction input by the user. Such information may be data indicative of a waveform or a combination of the modified extracted data, or data indicative of a combination of the extracted data and the selected replacing material data. The thus-stored file can be read out by the information processing terminal 10 alone designating the file name.

Note that the user may adjust the start or end time of the extracted material data by adjusting the time-axial length of the extraction windows wk1, wk2, . . . . If the start or end time of the extracted material data has been adjusted like this, the information processing terminal 10 may transmit information indicative of the changed start or end time to the server apparatus 50, and the control section 51 of the server apparatus 50 may perform the operation of step S250 on the extracted material data as changed material data.

The foregoing has been a description about the behavior of the sound generation control system 1 during execution of the similar-sound replacement program.

<Behavior During Execution of the Template Sequence Program>

Figure 14:
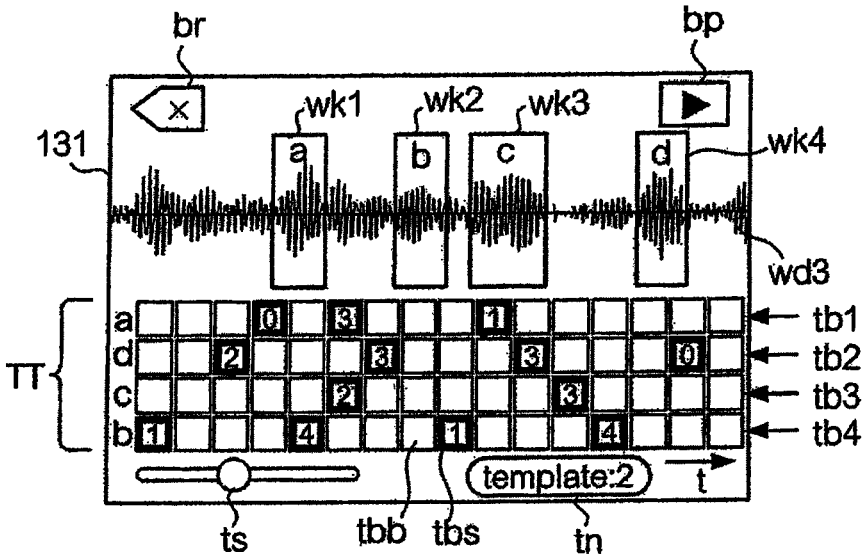
FIG. 14 is a diagram explanatory of a display screen during execution of a template sequence program in the embodiment of the present invention.

FIG. 14 is a diagram explanatory of a display screen during execution of the template sequence program. According to the template sequence program, a plurality of (e.g. sixteen) templates are prepared in advance, and material data is sounded or audibly generated at sound generation timing defined in a selected one of the templates.

To execute the template sequence program, the user operates a shift instruction button bts that receives user's operation for instructing a shift to the template sequence program on the aforementioned screen of FIG. 13 for setting a material data replacing style (i.e., that is operable by the user to instruct a shift to the template sequence program on the screen of FIG. 13). The waveform wd3 displayed in the above-mentioned material data replacing style setting screen is displayed in a waveform region provided in an upper section of FIG. 14, and a plurality of (four in the illustrated example of FIG. 13) tracks are shown in a track region TT provided in a lower section of FIG. 14. The track region TT corresponds to the above-mentioned icon placement region ST. Namely, the tracks (corresponding to tb1 to tb4 of FIG. 13) are, from up to down, referred to as the first, second, third and fourth tracks. The tracks tb1, tb2, tb3 and tb4 are provided in corresponding relation to the extraction windows wk1, wk2, wk3 and wk4. "a", "b", "c" and "d" indicated in the extraction windows wk1, wk2, wk3 and wk4 correspond to "a", "b", "c" and "d" indicated to the left of the tracks tb1, tb2, tb3 and tb4 of the track region TT, so that it is possible to know data of which portions in the waveform region correspond to similar sounds of which tracks.

Each of the tracks tb1, tb2, tb3 and tb4 indicates, in a horizontal direction of the screen, individual sound generation timing for 16 beats of one measure; namely, the sound generation timing progresses sequentially, one beat by one beat, from the left-end icon. Namely, the horizontal axis direction in the track region represents the time axis as in the above-mentioned icon placement region ST. Each sound generation timing is indicated by a rectangular icon image in FIG. 14. Of the icon images, each icon image displayed as a light display (i.e., thick-frame display) indicates sound generation timing (such an icon image will hereinafter be referred to as "sound generation icon image tbs"), and a numerical value indicated in the thick frame indicates a type of a selected similar sound (that corresponds to a type of the above-mentioned replacing material data). For example, "1", "2", . . . indicates replacing material data determined in accordance with a similarity to the extracted material data, and "0" indicates material data corresponding to an extraction window in the waveform wd3. Each of the sound generation icon images tbs corresponds an icon image with which the feature amount information of the extracted material data is associated in accordance with the track where the icon image tbs is displayed. Namely, the tracks arranged in the vertical axis direction of the screen constitutes a feature amount defining axis for defining feature amount information. On the other hand, each icon image displayed as a dark display (i.e., thin-frame display in FIG. 13) indicates non-sound-generation timing (such an icon image will hereinafter be referred to as "silent icon image tbb").

For example, in the first track tb1, the material data corresponding to the extraction window wk1 is sounded at the first beat, material data identified to be the third most similar to the material data corresponding to the extraction window wk1 is sounded at the sixth beat, and material data identified to be the first most similar to the material data corresponding to the extraction window wk1 is sounded at the tenth beat.

By operating (i.e., touching) any one of the sound generation icon images tbs to change the numerical value of the icon image tbs, the user can cyclically select the type of the corresponding similar sound. Whereas the example of FIG. 14 is illustrated in relation to one measure of sixteen beats, the measure may be of duple time or the like, and the number of the measures may be two, four or the like; namely, any desired type of time and any desired number of measures may be chosen.

Further, whereas the templates have been described above as predefined by the template sequence program, the user may create templates or modify or process existing templates. Templates created or processed like this may be stored into the storage section 15 as noted above so that they are read out and used in response to the user subsequently executing the template sequence program. Furthermore, the number of the icon images displayed in the track region TT may be increased or decreased in accordance with the total number of beats, or the icon images may be displayed in a scrolling manner. Furthermore, newly-created templates as well as templates prepared in advance may be used. In such a case, the user newly sets feature amount information and determines material data similar to the newly-set feature amount information from among the material data extracted at above-mentioned step S240 of FIG. 10. In addition, sound generation timing may be set as desired for the individual tracks.

A slider is provided in a left lower portion of the screen is slidable by the user to designate a desired performance tempo. A template button tn provided in a right lower portion of the screen is operable to select a desired one of the templates. Each time the user touches the template button tn, the template of one template number changes to the template of the next template number. Thus, by sequentially touches the template button tn, the user can select a desired type of template; in the illustrated example, the template of template number "2" is currently selected.

Types of similar sounds may be displayed by different brightness or thickness of color of the sound generation icon images tbs instead of the numerical values indicated in the sound generation icon images tbs. Similarly, correspondence relationship between the tracks tb1, tb2, tb3 and tb4 and the extraction windows wk1, wk2, wk3 and k4 may be indicated by different colors or the like instead of the alphabetical letters.

FIG. 15 is a diagram showing "template 2" of FIG. 14 for use in the template sequence program in the embodiment of the present invention. The template defines feature amount information for selecting material data allocated to the individual tracks and sound generation timing in the individual tracks. The feature amount information shown in FIG. 15 is of the same construction as the feature amount information in the feature amount designating data of FIG. 6. The sound generation timing is defined as a combination of a measure number and timing value (e.g., timing value of one beat is 120) in the measure. For example, sound generation timing "1: 360" shown in FIG. 15 indicates the third beat in the first measure. As noted above, in the case where DB designating data is used, a reproduction time range may be designated using a combination of a measure number and timing value in the measure in conformity with the form of the timing data of the template. Further, a region corresponding to the DB placement region DT may or need not be displayed on the display screen 131.

Allocation, by the template, of material data to the individual tracks may be effected by the information processing terminal 10 transmitting information of individual templates as well to the server apparatus 50 at the time of transmission, to the server apparatus 50, of clipped data during execution of the similar-sound replacement program and by the server apparatus 50 allocating, to the tracks, material data similar to the feature amount information of the individual templates and then transmitting the allocated material data to the information processing terminal 10 together with extracted data. Then, the information processing terminal 10 allocates correspondence relationship between the tracks and the material data by use of an allocation table and stores the correspondence relationship between the material data and the tracks into the temporary storage region. In the illustrated example of FIG. 14, material data corresponding to the extraction window wk1 is allocated to the first track tb1, material data corresponding to the extraction window wk2 is allocated to the second track tb2, material data corresponding to the extraction window wk3 is allocated to the third track tb3, and material data corresponding to the extraction window wk4 is allocated to the fourth track tb4.

Although it is common to use the sixteen templates as differing from one another in feature amount and sound generation timing, some of the templates may share same feature amounts or sound generation timing with another template so that the quantity of data to be communicated between the server apparatus 50 and the information processing terminal 10 and the quantity of calculations performed in the server apparatus 50 can be reduced.

Once the user instructs reproduction by operating the reproduction button by while the screen of the content shown in FIG. 14 is displayed on the display screen 131, the control section 11 of the information processing terminal 10 reproduces and outputs, as tone data, material data, determined in accordance with the numerical value indicated in any one of the sound generation icon images tbs displayed in the track region TT, in such a manner that the material data is audibly generated through the speaker 161 at the sound generation timing corresponding to the position of the sound generation icon image tbs.

Then, in response to an instruction input by the user, the control section 11 stores, into the non-volatile memory of the storage section 15, the data of the individual templates and the allocation table as a single file with a file name designated therefor, so that the thus-stored file can be read out by the information processing terminal 10 alone using the file name.

<Example Application to DAW>

The information processing terminal 10 has been described above as applied to a tablet terminal, portable telephone, PDA or the like. As another example application, the individual functions of the information processing terminal 10 may be implemented by application software called "DAW" (Digital Audio Workstation) being run on an OC (Operating System) of a PC (Personal Computer). Namely, the information processing terminal 10 can be implemented as a music processing apparatus by means of a PC where the DAW is running. Such a music processing apparatus is capable of performing a series of music processes, such as recording/reproduction, editing and mixing of audio signals and MIDI (Musical Instrument Digital Interface) events, and the above-mentioned sequence program and template sequence program are provided as functions of the music processing apparatus.

When the personal computer (PC) executes given application software of the DAW, the given application software can operate in conjunction with the above-mentioned sequence program to extract feature amounts from signals reproduced by a MIDI sequencer, which controls recording/reproduction of MIDI events, to create sequence data and record, as audio signals, material data corresponding to the extracted feature amounts. Namely, the personal computer (PC) that executes the application software can communicate data between the MIDI sequencer and the sequence program and record and edit audio signals from data created by the sequence program Further, when the personal computer (PC) executes given application software of the DAW, the given application software can operate in conjunction with the above-mentioned template sequence program to create MIDI tracks of the MIDI sequencer from the tracks of the template sequence program or conversely create templates of the template sequence program by use of timing information of the tracks of the MIDI sequencer and create MIDI data of one or more of the tracks of the template sequence.

Further, when the personal computer (PC) executes mixer-related application software and when the user selects or designates a track by use of a mixer screen of DAW's application software, input/output tracks of the sequence program are handled in such a manner that any of them can be selected or designated on the mixer screen similarly to other MIDI tracks and audio tracks. Thus, it is possible to mix together reproduced signals of MIDI data and the above-mentioned sequence data to output the mixed result, and mix together reproduced signals of audios and the above-mentioned sequence data to output the mixed result. Note that the personal computer (PC) may execute only the sequence program to perform reproductive output and recording based on the sequence program alone.

Furthermore, at the time of data storage and reproduction in the DAW's application, the above-mentioned sequence data and DB designating data may be provided as constituent data of a project file and organized into the single project file. Thus, in this case, the project file comprises the above-mentioned sequence data and DB designating data in addition to, for example, a header, data of audio tracks (i.e., management data and waveform data of a plurality of tracks), data of an audio mixer (parameters of the plurality of channels), data of MIDI tracks (sequence data of the plurality of tracks), data of a software tone generator (parameters of an activated software tone generator), data of a hardware tone generator (parameters of the hardware tone generator registered in a tone generator rack), data of a software effecter (parameters of an activated software effecter), data of a hardware effecter (parameters of an inserted hardware effecter), tone generator table, effecter table, data of a tone generator LAN and other data.

With such arrangements, a great quantity of audio data supplied by the DAW's application can be used as bases of the sequence data and material data, so that not only usability of the sequence program can be greatly enhanced but also the sequence program can be used a tool of the MIDI sequencer or audio data editing work.

<Modifications>

<Modification 1>

The icon images displayed in the icon placement region ST in the above-described preferred embodiment may be made expandable or stretchable or contractable in the time-axis direction in response to an instruction input by the user.

Figure 16:
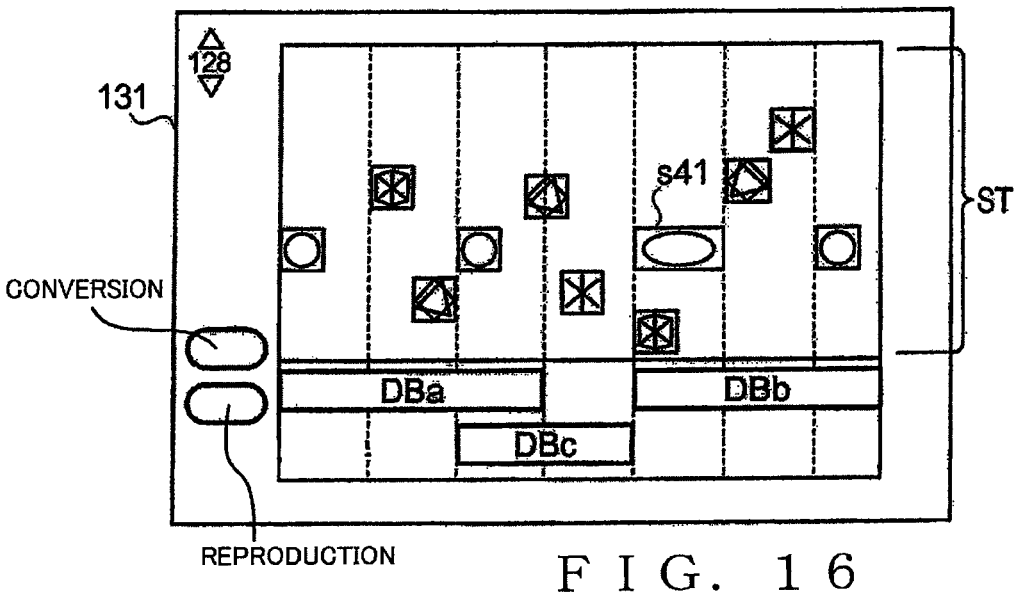
FIG. 16 is a diagram explanatory of an example display presented on the display screen during execution of the sequence program in modification 1 of the present invention.

FIG. 16 is a diagram explanatory of an example display presented on the display screen during execution of the sequence program in modification 1 of the present invention. In response to an instruction input by the user, the display control section 110 changes the length of a particular one of the icon images in a direction along the time axis (time axis direction). For example, the display control section 110 stretches the icon image s4 of FIG. 8 in the time axis direction as indicated by an icon image s41 in FIG. 16. In this case, when outputting the material data corresponding to the icon image s41 via the output section 140, the sound control section 130 may process the material data by performing, in accordance with the time-axial length of the icon image s41, a time stretch process for expanding the waveform of the material data, a loop process for repetitively outputting the material data, etc. and then output the resultant processed material data as tone data via the output section 140. In this case, necessary information, such as sound generation end timing and loop reproduction flag, is added as sequence information.

All of the icon images are shown in FIG. 8 as having the same size, and the instant modification has been described above as stretching or expanding any one of the icon images in the time axis direction. Alternatively, even when the icon image is stretched, it may be displayed with a length corresponding to an estimated reproduced sound length of material data identified as being similar to the feature amount information that corresponds to the icon image.

<Modification 2>

The vertical axis of the icon placement region ST in the preferred embodiment has been described as a coordinate axis representing sound volumes (i.e., sound volume axis). However, the present invention is not so limited, and, the vertical axis may be a coordinate axis representing sound pitches, lengths or the like (which will hereinafter be referred to as "designating coordinate axis"). Namely, the icon placement region ST may have a designating coordinate axis representing designation values designating processing content, other than sound volumes, of material data. If the designating coordinate axis is one representing pitches, the sound generation control section 130 may change the pitch of the material data in accordance with a position, on the designating coordinate axis, the icon image and then output the pitch-changed material data as tone data via the data output section 140. If the designating coordinate axis is one representing sound lengths, the sound generation control section 130 may perform a time stretch process) for expanding the waveform of the material data), a loop process (for repetitively outputting the material data), etc. in accordance with a position, on the designating coordinate axis, the icon image and then output the thus-processed material data as tone data via the data output section 140.

Further, processing content designated by the designating coordinate axis may pertain to a plurality of types of factors, such as sound volume and pitch, in which case the designating coordinate axis may be switched among the plurality of types in response to an instruction input by the user so that the icon image is placed at a position along the switched coordinate axis. The material data may be processed variously by placing the icon image in the icon placement region ST having such a switchable designating coordinate axis.

<Modification 3>

Whereas the vertical axis of the icon placement region ST in the preferred embodiment has been described as a designating coordinate axis designating processing content of material data, it may be a coordinate axis representing identification values for identifying material data by means of the identification section 510 (such a coordinate axis will hereinafter be referred to as "identifying coordinate axis"). In this case, the identification section 510 may identify material data in accordance with a position, on the identifying coordinate axis, of the icon image. For example, in the case where the identification values represent similarities, an arrangement may be made such that material data having a lower similarity to the extracted material data (i.e., having feature amount information of a greater Euclidian distance from the feature amount information of the extracted material data) is identified by the identification section 510 if the icon image is located more upward in the icon placement region ST.

Such similarities may be designated in accordance with an algorithm (e.g., random algorithm) in which similarities are predetermined in association with all or pre-designated ones of the icon images, in response to the user performing predetermined operation (e.g., random button operation), rather than being designated by the user.

Further, the above-mentioned identification values may pertain to a plurality of types of factors, in which case the icon image may be placed in a switchably-selected one of the identifying coordinate axis in the icon placement region ST and the designating coordinate axis in modification 2. Another example of the type of the identification values may be categories into which the feature amount information corresponding to the icon images are classified, in which case the identification value on the identifying coordinate axis may be changed to change the feature amount information and thereby change the category.

<Modification 4>

According to the above-described preferred embodiment, the content displayed on the display screen 131 is switched from the content of FIG. 12 to the content of FIG. 13, through execution of the similar-sound replacement program, so that replacing material data as a similar sound is selected by the user from among various options. However, the present invention is not so limited, and, in modification 4, content of FIG. 17 may be displayed so that replacing material data may be selected in a different manner from the aforementioned. The following describe, with reference to FIGS. 17 and 18, displayed content on the display screen 131 and behavior of the sound generation control system 1 in modification 4.

Figure 17:
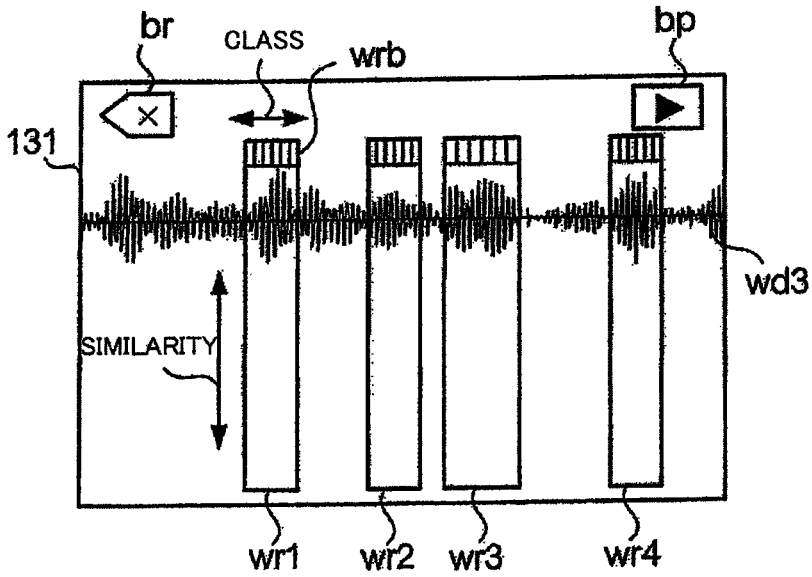
FIG. 17 is a diagram explanatory of a screen for designating replacing material data during execution of the similar-sound replacement program in modification 4 of the present invention.
Figure 18:
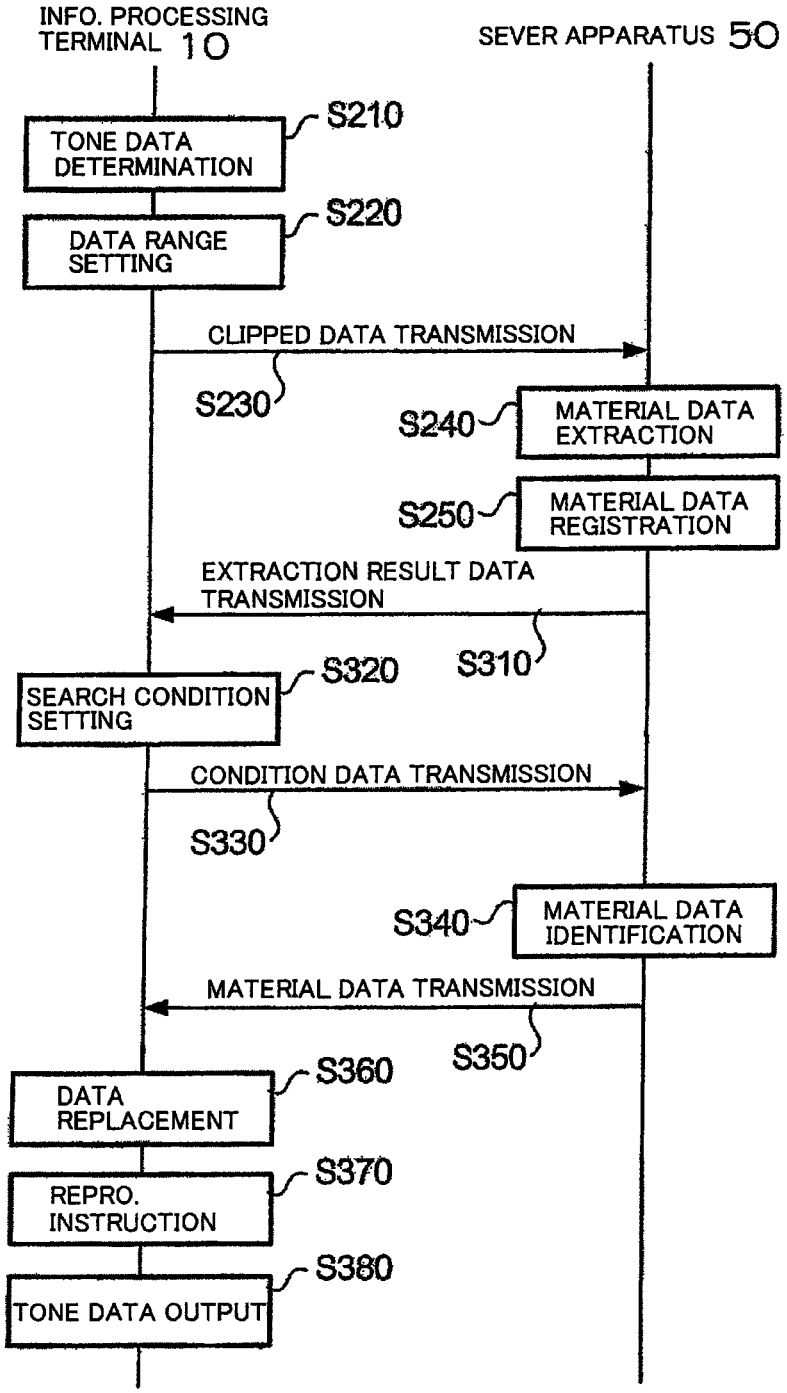
FIG. 18 is a diagram explanatory of behavior of the sound generation control system during execution of the similar-sound replacement program in modification 4 of the present invention.

FIG. 17 is a diagram explanatory of a screen for designating replacing material data during execution of the similar-sound replacement program, and FIG. 18 is a diagram explanatory of behavior of the sound generation control system 1 during execution of the similar-sound replacement program in modification 4. Operations of step S210 to step S250 shown in FIG. 18 are similar to the above-described operations in the preferred embodiment and thus will not be described here to avoid unnecessary duplication.

The control section 51 of the server apparatus 50 transmits, as extraction result data, information indicative of material data extracted from clipped data (i.e., information indicative of a data range in the clipped data and feature amount information), via the communication section 54 (step S310).

Once the information processing terminal 10 receives the extraction result data, the control section 11 of the information processing terminal 10 switches the displayed content on the display screen 131 to the content of FIG. 17. In the illustrated example of FIG. 17, the waveform wd3 of the clipped data and the extraction windows wr1, wr2, . . . are displayed on the display screen 131. A region where the extraction windows are displayed corresponds to the above-mentioned icon placement region ST, and a horizontal axis of the region corresponds to the time axis. Each of the extraction windows corresponds to an icon image with which feature amount information of the extracted material data is associated.

In the illustrated example, the extraction windows wr1, wr2, . . . are displayed in colors corresponding to categories into which respective feature amount information is classified. Here, each of the extraction windows is filled in a translucent color corresponding to the category such that the color becomes deeper or darker in a down-to-up direction while the color becomes lighter deeper in an up-to-down direction. The following description will be made in relation to the extraction window wrl.

A class switching region wrb is displayed in an upper end portion of the extraction window wrl. The class switching region wrb is divided into a plurality of sub regions, and these sub regions are filled with respective ones of colors corresponding to the categories. Further, vertical positions (i.e, positions in the vertical axis direction) in the extraction window wrl are associated with similarities in such a manner that the similarity increases in the down-to-up direction; namely, the similarity and the color density are correlated to each other.

Once the user designates any position of the class switching region wrb, the control section 11 changes the color of the extraction window wrl of the display screen 131 to the color of the sub region which the user-designated position belongs to. At that time, the color density gradation pattern that the color becomes deeper in the down-to-up direction while the color becomes lighter deeper in the up-to-down direction does not change. In this manner, the control section 11 sets the category corresponding to the changed-to color as a search-target class. If such user's designation is not made, then the original category in which the feature amount information of the material data corresponding to the extraction window is classified is set as-is as a search-target class. Once any position inside the extraction window wrl is designated by the user, the control section 11 sets, as a search condition, a similarity corresponding to a vertical axial position of the user-designated position. In the aforementioned manner, the control section 11 sets, as search conditions, the class and similarity (step S320).

Once the reproduction button by is operated by the user, the control section 11 transmits, via the communication section 14, condition data, indicative of the search conditions, in association with information identifying material data in the extraction window (step S330).

Once the server apparatus 50 receives the condition data, the control section 51 identifies material data similar to the feature amount information of the extracted material data in a similar manner to step S260 in the above-described preferred embodiment (step S340). However, in the illustrated example, unlike in the preferred embodiment, the control section 51 identifies material data on the basis of the condition data. Namely, the search target here is material data stored in the feature amount DB and having feature amount information classified into the category indicated by the condition data. Further, such material data are sequentially identified in descending order of similarities, i.e. starting with the one having the smallest Euclidian distance. Namely, material data with feature amount information having higher similarities and closer Euclidian distances to the feature amount information of the extracted material data than the others are identified. In the case where the DB designating data is employed, as noted above, the control section 51 determines a type of feature amount DB, which becomes a search target at the time of identification of material data, on the basis of the DB designating data.

Once the control section 51 identifies material data on the basis of the condition data, it transmits, to the information processing terminal 10 via the communication section 54, the identified material data and information identifying replacing material data in association with each other (step S350).

Upon receipt of these data from the server apparatus 50, the control section 11 of the information processing terminal 10 replaces the extracted material data with the identified material data (step S360). Once the user instructs reproduction by operating the reproduction button by (step S370), the control section 11 reproduces the clipped data having been subjected to the material data replacement, to thereby output the clipped data as tone data (step S380), so that the tone data is audibly generated through the speaker 161.

Figure 19:
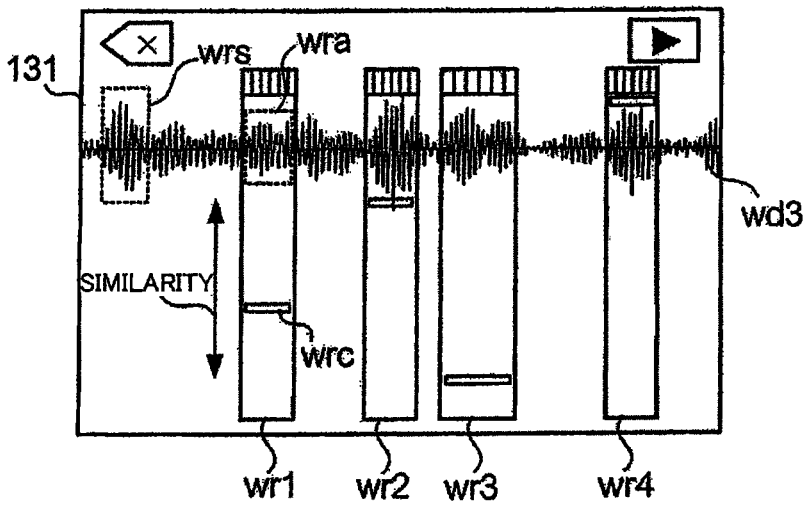
FIG. 19 is a diagram explanatory of a modification of the screen shown in FIG. 17.

FIG. 19 is a diagram explanatory of a modification of the screen shown in FIG. 17. In the illustrated example of FIG. 19, a horizontal bar-shaped marker wrc is displayed in each of the extraction windows at a user-designated position in the vertical axis direction (representing similarities). Thus, the user can readily known how much degree of similarity is currently designated. Further, in the illustrated example of FIG. 19, a portion wra of the waveform wd3 included in the extraction window wr1 is being displayed replaced with a waveform of the replacing material data. It should be appreciated that the above explanation applies to the other extraction windows wr2, wr3 and wr4.

Here, each of the extraction windows indicates a portion of material data extracted in the server apparatus 50. Further, a user-designated portion (e.g., portion wrs shown in FIG. 19) may be added as a portion of material data extracted in the server apparatus 50. In this case, information indicative of the portion wrs may be transmitted from the information processing terminal 10 to the server apparatus 50 so that a waveform of the portion wrs is handled as having been extracted as material data at step S240 of FIG. 18. Namely, the number of the extraction windows may be increased by using the portion wrs as a user-designated extraction window. Further, the user may delete the user-designated extraction window.

Whereas the foregoing has been described in relation to the case where similarities are designated by the user, such similarities may be designated in accordance with an algorithm (e.g., random algorithm) in which similarities are predetermined in association with all or pre-designated ones of the extraction windows, in response to the user performing predetermined operation (random button operation).

Further, sound volumes with which portions included in the extraction windows and the other portions are to be reproduced may be made adjustable separately from each other. Such sound volume adjustment may be controlled with an continuous amount or intermittently in an ON/FF fashion. Also, the sound volume adjustment may be performed separately for each of the extraction windows. In this way, sounds can be audibly generated with material data portions made outstanding or non-outstanding. These modified features are also applicable while the display of FIG. 13 described above in relation to the preferred embodiment is being presented on the display screen 131.

Further, as described above in relation to the preferred embodiment, the user may adjust the time-axial lengths of the extraction windows wr1, wr2, . . . so that the start and end times of extracted material data are adjustable.

<Modification 5>

In the above-described preferred embodiment, the operation of step S170 shown in FIG. 9, i.e. the operation for outputting tone data via the data output section 140 during execution of the sequence program, is implemented by the sound generation control section 130 outputting material data at timing corresponding to a position, on the time axis, of an icon image. However, the present invention is not so limited, and, in modification 5, tone data may be generated by the sound generation control section 130 as data indicative of content of sound generation in an entire output time period and then output via the data output section 140. The sound generation control section 130 may store the generated tone data into the storage section 15. Further, instead of being stored as tone data itself, the material data may be stored as a combination of a plurality of various types of data necessary for generating tone data, such as combinations of sequence data and the material data. Instructions for storing various types of data may be input by the user.

Further, in the above-described preferred embodiment, sounds based on such tone data are output through the speaker 161 of the information processing terminal 10. Alternatively, sounds based on such tone data may be output through an external speaker device connected to the information processing terminal 10 or through the server apparatus 50. Namely, the sound generation control section 130 may control not only the structural components of the information processing terminal 10 but also structural components connected to the information processing terminal 10.

<Modification 6>

In the above-described preferred embodiment, the icon images, DB images, etc. to be displayed on the display screen 131 during execution of the sequence program are generated by programs. However, the present invention is not so limited, and, in modification 6, such images may be prestored in the storage section 15, 55 or the like.

<Modification 7>

In the above-described preferred embodiment, content of the feature amount information corresponding to the icon images to be displayed in the icon placement region ST is determined in accordance with an instruction input by the user. However, the present invention is not so limited, and, in modification 7, the user may select a design of a desired icon image to thereby determine, as feature amount information, a representative value predetermined for the category corresponding to the selected design.

<Modification 8>

In the above-described preferred embodiment, content of the DB designating data is determined by the user placing DB images in the DB placement region DT. However, the present invention is not so limited, and, in modification 8, relationship between the reproduction time ranges and the feature amount DB types may be determined automatically by the control section 11.

<Modification 9>

The above-described preferred embodiment may be modified in such a manner that, if there is a reproduction time range where no type of feature amount DB is designated by the DB designating data, a predetermined type of feature amount DB (all or one or some particular ones of a plurality of types) or a type designated in an immediately preceding reproduction time range is designated as a search target for that reproduction time range.

<Modification 10>

Whereas, in the above-described preferred embodiment, the sound generation control system 1 comprises the information processing terminal 10 and the server apparatus 50 interconnected via the communication line 1000, it may comprise the information processing terminal 10 and the server apparatus 50 constructed as an integral unit without the intervention of the communication line 1000. Further, even where the information processing terminal 10 and the server apparatus 50 are provided as separate apparatus, one or some of the structural components of the information processing terminal 10 may be included in the server apparatus 50, or conversely, one or some of the structural components of the server apparatus 50 may be included in the information processing terminal 10. Further, it is only necessary that various information described above as stored in the storage section 15 of the information processing terminal 10 and various information described as stored in the storage section 55 of the server apparatus 50 be stored in any storage section in the entire sound generation control system 1. For example, a storage device for storing all or part of the various information may be connected to the communication line 1000 rather than the information processing terminal 10 and server apparatus 50. Further, the various information may be shared with another information processing terminal 10 connectable to the communication line 1000 so that another user can use the various information.

For example, the feature amount DB may be stored in the storage section 55 of the server apparatus 50 and the clipped data DB may be stored in the storage section 15 of the information processing terminal 10 so that the functions of the identification section 510 can be implemented. Furthermore, the search program and the extraction program may be executed in the information processing terminal 10, or may be executed in the server apparatus 50 on the basis of information acquired from the information processing terminal 10.

Furthermore, the present invention is not limited to the construction where software arrangements based on the aforementioned sequence program and template sequence program the modification are implemented by a computer or processor. The present invention may be constructed by hardware of a specialized sequencer. If the present invention is applied to the DAW and only cooperation with the MIDI sequencer suffices, then the aforementioned sequence program and template sequence program may be applied to the MIDI sequencer.

Figure 20:
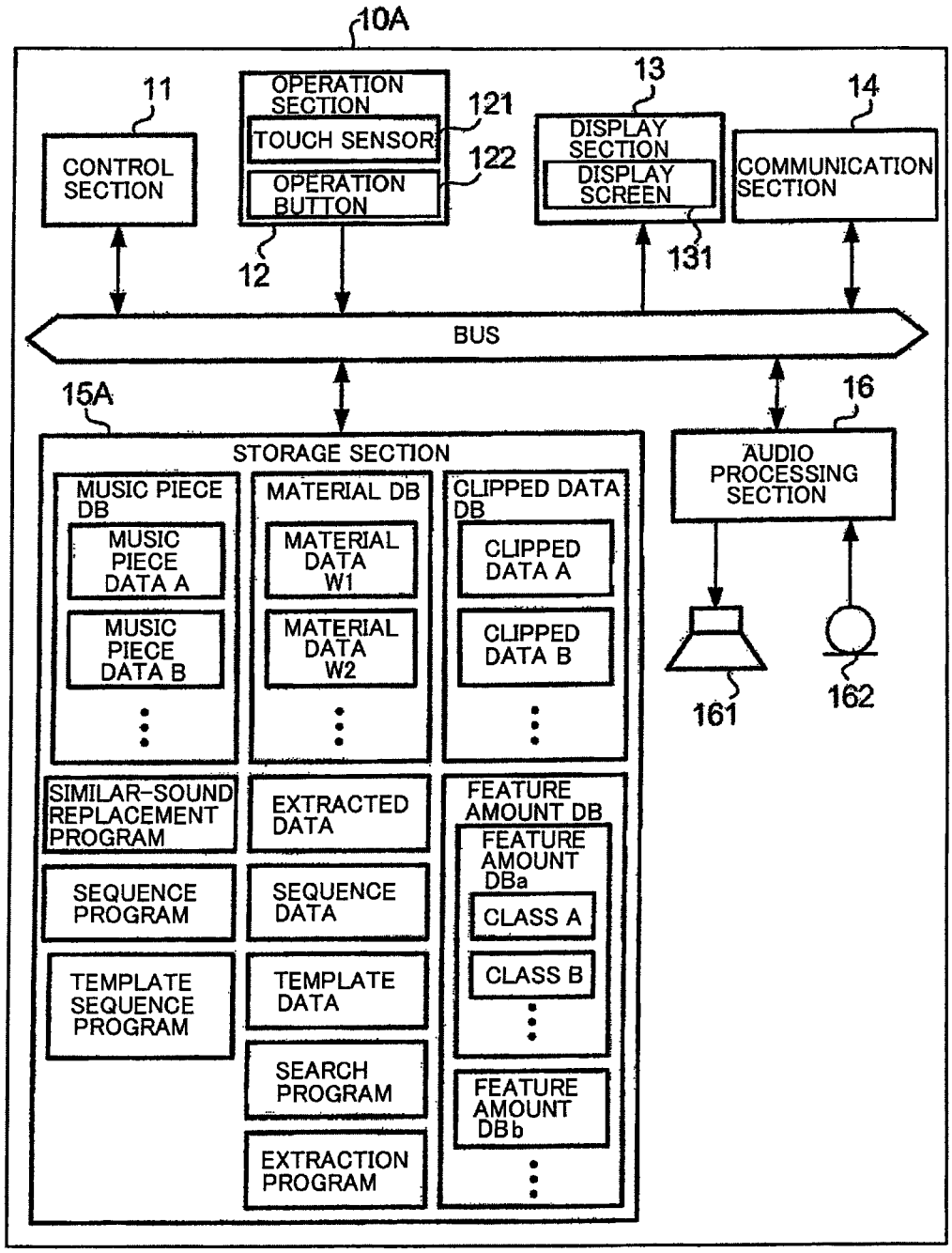
FIG. 20 is a diagram explanatory of a construction of the information processing terminal in modification 10 of the present invention.
Figure 21:
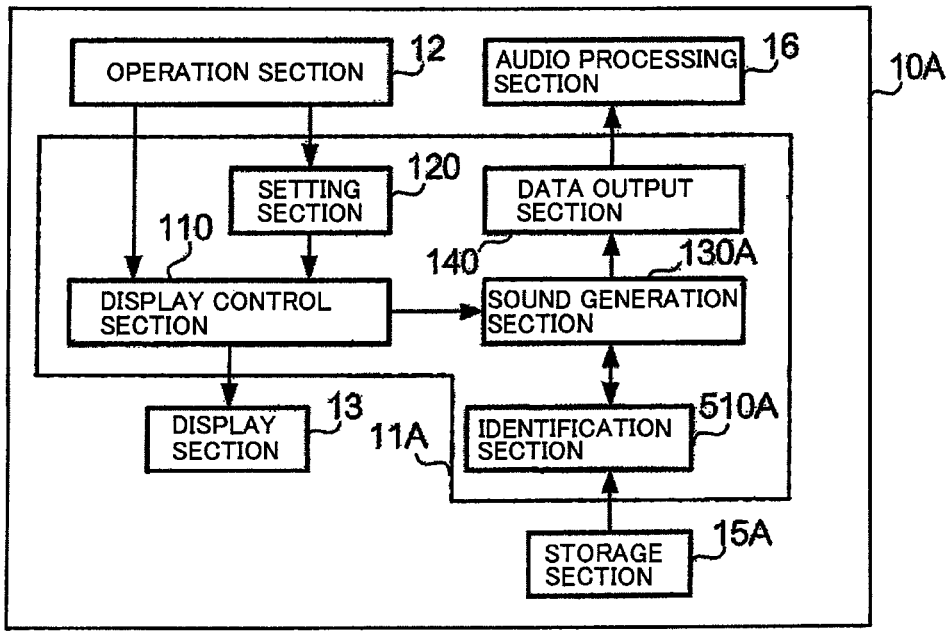
FIG. 21 is a functional block diagram explanatory of functions of the information processing terminal in modification 10 of the present invention.

The following describe, with reference to FIGS. 20 and 21, an information processing terminal 10A where the above-described information processing terminal 10 and server apparatus 50 are constructed as an integral unit.

FIG. 20 is a diagram explanatory of a construction of the information processing terminal 10A in modification 10. In the following description, only structural components different from those of the information processing terminal 10 provided in the above-described preferred embodiment, such as a control section 11A and a storage section 15A, will be described with a description about the same structural components as in the information processing terminal 10 (i.e., structural components of the same reference numerals and characters as in the information processing terminal 10) omitted to avoid unnecessary duplication.

The storage section 15A is a combination of the storage section 15 and storage section 55 employed in the above-described preferred embodiment; namely, the storage section 15A stores both content described above as stored in the storage section 15 and content described above as stored in the storage section 55.

The control section 11A executes both of the programs executed separately by the control sections 11 and 51 in the above-described preferred embodiment. Programs to be executed together, such as the sequence program and search program, may be integrated and stored in the storage section 15A as a single program.

The following describe, with reference to FIG. 21, functions implemented by the control section 11A executing the sequence program and search program.

FIG. 21 is a functional block diagram explanatory of functions of the information processing terminal 10A in modification 10. As shown in FIG. 21, the information processing terminal 10A in modification 10 is different from the information processing terminal 10 shown in FIG. 7 in that the sound generation control section 130A and the identification section 510A communicate information with each other without the intervention of the communication section. The other aspects of information processing terminal 10A are similar to the information processing terminal 10 and thus will not be described here to avoid unnecessary duplication.

<Modification 11>

The number of tracks in the template sequence program is not limited to four and may be more or less than four. The number of tracks may be indefinitely great (in effect, as great as the system permits). In such a case, a great multiplicity of feature amount data are placed on the time axis, and similar sounds and feature amount parameters can be changed independently of one another.

<Modification 12>

Whereas the above-described preferred embodiment is arranged to acquire material data as necessary from the clipped data DB in accordance with a data range of the feature amount DB, only material data of portions clipped in advance may be prestored, in which case information indicative of a data range need not be stored in the feature amount DB.

<Modification 13>

Whereas the above-described preferred embodiment is arranged to search through the feature amount DB to identify material data having a high similarity to feature amount information of extracted material data (see step S260 of FIG. 10), a threshold value may be set in the similarity, in order to exclude material data having more than a predetermined Euclidian distance corresponding to a threshold value because, if too similar material data is extracted, it does not create a particular change from the original sound, or in order to exclude material data having less than a predetermined Euclidian distance corresponding to a threshold value so that material data too distant from the extracted material data is not identified. Further, both of the above-mentioned threshold values may be employed. Such threshold values may be set by the user.

<Modification 14>

In the foregoing description about the preferred embodiment and modification 4, it has been stated that the user may be allowed to adjust the time axial lengths of the extraction windows, an arrangement may be made to permit finer time axial length adjustment.

Figure 22:
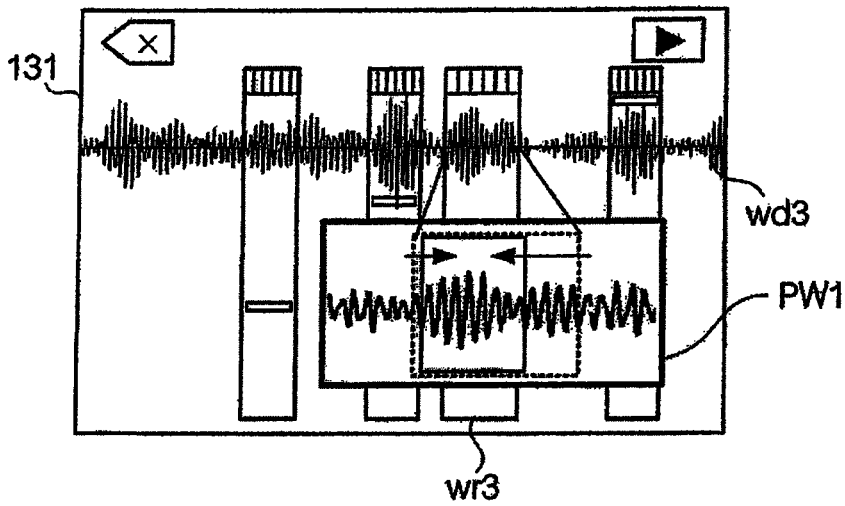
FIG. 22 is a diagram explanatory of a screen for designating material data to be replaced during execution of the similar-sound replacement program in modification 14 of the present invention.

FIG. 22 is a diagram explanatory of a screen for designating material data to be replaced during execution of the similar-sound replacement program in modification 14 of the present invention. More specifically, FIG. 22 shows displayed content when the user has performed predetermined operation (e.g., double-click operation) on the extraction window wr3 on the screen of FIG. 19 described above in relation to modification 4. A popup window PW1 shown in FIG. 22 is displayed in response to operation by the user and indicates, in enlarged scale, a waveform corresponding to the extraction window wr3. The user can adjust the time axial length of the waveform by changing the range of the waveform on the popup window PW1. Because the waveform is displayed in enlarged scale on the popup window PW1, the time axial length of the waveform can be adjusted finely.

Such time axial length adjustment on the popup window may also be performed on the display screen of FIG. 8 in the above-described preferred embodiment.

Figure 23:
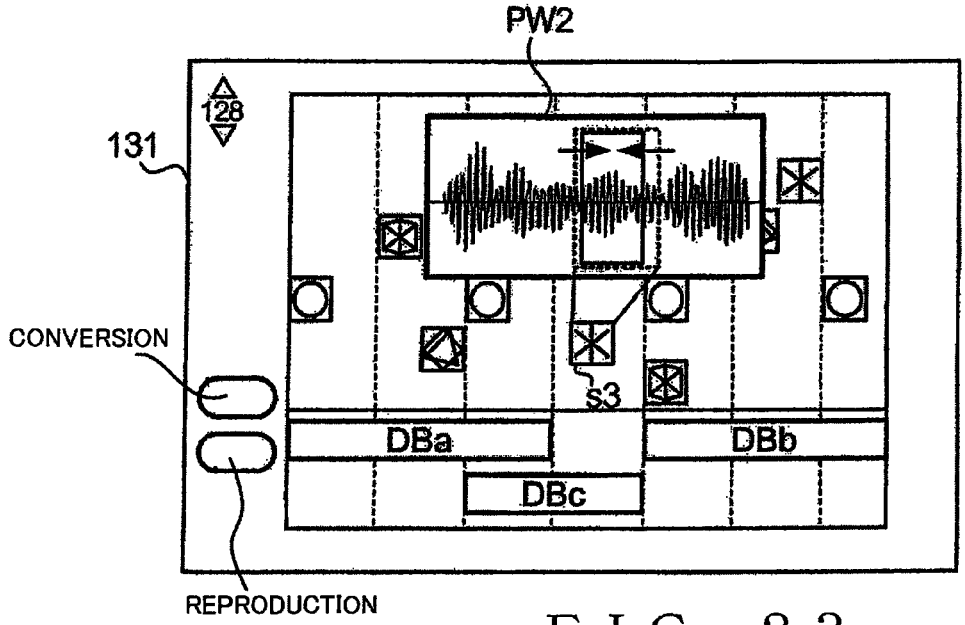
FIG. 23 is a diagram explanatory of an example display presented on the display screen during execution of the sequence program in modification 14 of the present invention.

FIG. 23 is a diagram explanatory of an example display presented on the display screen during execution of the sequence program in modification 14 of the present invention. More specifically, FIG. 23 shows displayed content when the user has performed predetermined operation (e.g., double-click operation) on the icon image s3 on the display screen of FIG. 8. A popup window PW2 shown in FIG. 23 is displayed in response to operation by the user and indicates, in enlarged scale, a waveform corresponding to the icon image s3. The "waveform corresponding to the icon image s3" is a waveform of a sound to be audibly generated in association with the icon image s3 at the time of reproduction. The user can adjust the time axial length of the waveform by changing the range of the waveform on the popup window PW2.

<Modification 15>

Figure 24:
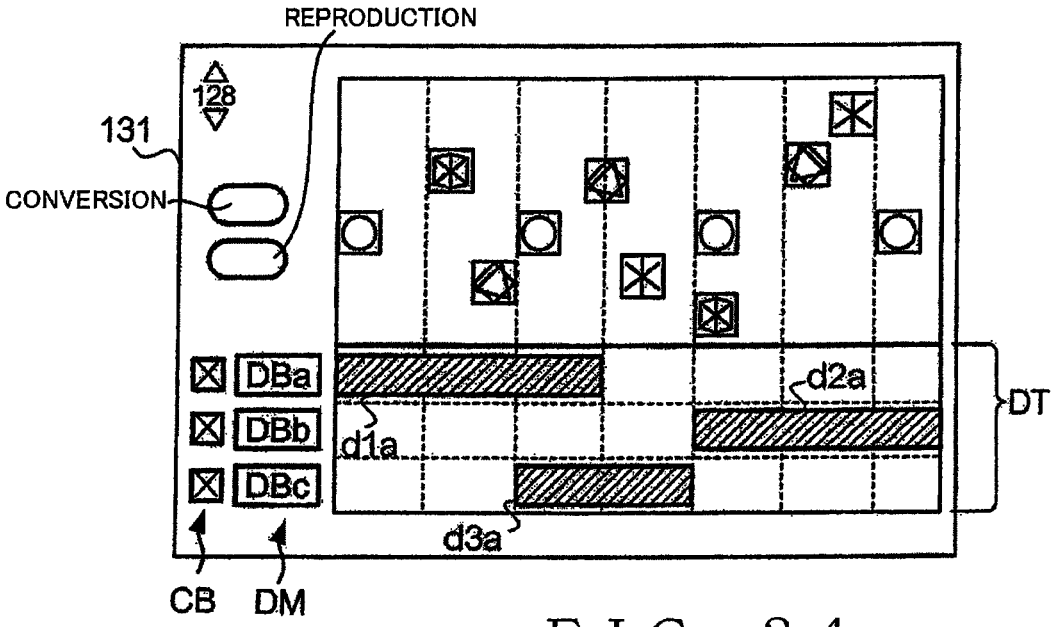
FIG. 24 is a diagram explanatory of an example display presented on the display screen during execution of the sequence program in modification 15 of the present invention.

Whereas, in the above-described preferred embodiment, DB images with which types of feature amount DBs are associated are displayed in the DB placement region DT, the types of feature amount DBs and the time ranges, which become search targets for the types, may be displayed separately from each other. FIG. 24 is a diagram explanatory of an example display presented on the display screen during execution of the sequence program in modification 15 of the present invention. In the DB placement region DT in the illustrated example of FIG. 24, designated types of feature amount DBs are displayed in a plurality of horizontal rows. DB period designating images d1*a*, d2*a*, . . . , indicative of time ranges in which the designated feature amount DBs become search targets, are placed in the individual horizontal rows. Further, a DB type designating region DM for designating the feature amount DB types is displayed to the left of the DB placement region DT. The user can change types of feature amount DBs, corresponding to the horizontal rows, via a popup menu or the like.

In the illustrated example of FIG. 24, feature amount databases DBa, DBb and DBc are designated, and, for example, the feature amount database DBa becomes a search target in a time range designated by a DB type designating image d1*a*. Although the display of FIG. 24 is different from the display of FIG. 8, the feature amount DB types and the time ranges, in which the feature amount DB types become search targets, are the same between the display of FIG. 8 and the display of FIG. 24.

Check boxes CB may be displayed to the left of the DB type designating region DM so that the user can designate whether the search targets designated in the corresponding horizontal rows should be made valid or invalid. Such check boxes CB may also be used in the display of FIG. 8.

<Modification 16>

In the above-described preferred embodiment, the icon images on the display of FIG. 8 are each positioned in accordance with feature amount information determined in response to a user's instruction. In modification 16, the user may search through the feature amount DB for desired feature amount information when designating feature amount information. For that purpose, a method disclosed, for example, in Japanese Patent Application Laid-open publication No. 2011-163171 may be employed. Further, at that time, feature amount DBs designated in the check boxes CB shown in FIG. 24 may be made search targets. Note that, when the user is about to designate feature amount information corresponding to the icon images, a display for designating feature amount information may be presented on a part of the display of FIG. 8. As another alternative, a popup window or the like may be displayed, in response to the user performing predetermined operation (e.g., double-click operation) on any one of the icon images, so that the user can designate feature amount information corresponding to the operated icon image.

<Modification 17>

In the above-described preferred embodiment of the present invention, a type of feature amount DB and a time range, in which the type of feature amount DB becomes a search target, are designated by the user on the display of FIG. 8. In modification 17, such a type of feature amount DB and a time range may be designated, in response to the user performing predetermined operation (e.g., operation of a random button), in accordance with a predetermined algorithm (e.g., random algorithm). Alternatively, if types of feature amount DBs and time ranges, in which the types of feature amount DBs become search targets, are determined in advance as in the example of FIG. 8, any one of the types of feature amount DBs and time ranges may be changed, in response to the user designating any one of the DB images, in accordance with an algorithm (e.g., random algorithm) predetermined for the designated DB image. Further, through random selection of any one of the databases, an operation for placing the DB placement region DT itself in an active state (i.e., in a state where a feature amount-DB selecting function is alive) to permit selection of a feature amount DB or in an inactive state (i.e., in a state where a feature-amount-DB selecting function is not alive) to permit application of only a particular feature amount DB may be performed randomly. Further, an operation for placing a feature amount DB selected in the DB placement region DT in an active state (i.e., in a state where the selected feature amount DB is set as a search target) or in an inactive state (i.e., in a state where the selected feature amount DB is not set as a search target) may be performed randomly. In such a case, each of the DB images corresponding to the active feature amount DBs may be left in a colored state while each of the DB images corresponding to the inactive feature amount DBs may be placed in a grayed-out state or the like, so that whether any feature amount DB for which the display has been changed is active or inactive can be visually identified.

<Modification 18>

On the display of FIG. 8 presented in the above-described preferred embodiment, an icon image may be placed in a grayed-out state if there is no sound corresponding to the icon image. "no sound corresponding to the icon image" means, for example, a situation where there has been determined no feature amount DB that becomes a search target in a time range corresponding to the icon image, or a situation where there has been no material data identified by the identification section 510 on the basis of feature amount information corresponding to the icon image. "there has been no material data identified by the identification section 510" means, for example, a situation where material data identified to be most similar to the feature amount information corresponding to the icon image has only a similarity less than a predetermined threshold value of similarity, or a situation where, in the case where search targets are narrowed down by categories, the category corresponding to the icon image is not included in the search-target feature amount DB.

<Modification 19>

Each of the programs employed in the above-described preferred embodiment can be supplied stored in a computer-readable storage medium, such as a magnetic storage medium (like a magnetic tape or magnetic disk), an optical storage medium (like an optical disk), a magneto-optical storage medium or a semiconductor memory. Further, the information processing terminal 10 or the server apparatus 50 may download the programs via a network.

<Modification 20>

The preferred embodiment has been described above as storing a file created by the sequence program and a file created by the template sequence program into the non-volatile memory as separate files. In modification 20, the file created by the sequence program and the file created by the template sequence program is stored into the non-volatile memory in response to just one operation. At that time, these files may be either stored as separate files, for example, with different extensions, or stored combined together in a single file. Further, each of the file names may be automatically designated from information, such as a corresponding music piece name, date, etc., without being designated by the user.

This application is based on, and claims priorities to, JP PA 2011-045708 filed on 2 Mar. 2011 and JP PA 2011-242606 filed on 4 Nov. 2011. The disclosure of the priority applications, in its entirety, including the drawings, claims, and the specification thereof, are incorporated herein by reference.

What is claimed is:

1. A sound generation control apparatus comprising:

a display control section configured for displaying, on a display screen, an image of an icon placement region having a time axis and for displaying, in the icon placement region, an icon image in association with a desired time position on the time axis, wherein feature amount information is associated with the icon image, the feature amount information comprising a feature amount in the form of a value descriptive of a feature of material data comprising a waveform of a sound material, the value based on the material data comprising the waveform of the sound material;

a setting section configured for setting, in association with a desired time range on the time axis of the icon placement region, a particular database to be used, the particular database being selected from among a plurality of types of databases configured for storing material data in association with feature amount information; and a sound generation control section configured for acquiring, on the basis of the feature amount information associated with the icon image, the material data from the database set in association with the time range containing the time position where the icon image is placed, and for generating tone data on the basis of the acquired material data and the time position where the icon image is placed.

2. The sound generation control apparatus as claimed in claim 1, wherein said setting section is configured for designating a desired time range, on the time axis, in the icon placement region in response to user operation and for selecting, from among the plurality of types of databases, the particular database to be used in the designated time range.

3. The sound generation control apparatus as claimed in claim 1, wherein said display control section is configured for, in response to user operation, placing a desired icon image at a desired time position, on the time axis, in the icon placement region, or moving a desired one icon image, displayed in the icon placement region, to thereby change the time position of the desired one icon image.

4. The sound generation control apparatus as claimed in claim 1, wherein said display control section is configured for displaying a plurality of the icon images in the icon placement region, said setting section is configured for designating a plurality of desired time ranges on the time axis of the icon placement region, and said sound generation control section is configured for generating tone data based on material data corresponding to individual ones of the icon images in a particular order corresponding to the time positions where the icon images are placed.

5. The sound generation control apparatus as claimed in claim 4, wherein said display control section is configured for displaying the plurality of the icon images on the basis of sequence data defining a time-series combination of a plurality of material data, and for performing, in response to user operation, editing including displayed position change, deletion and insertion of the displayed icon images, and said setting section is configured for designating the time ranges and setting a database for each of the designated time ranges on the basis of the sequence data, and for performing editing, including change of the time ranges and the database, in response to user operation, the sequence data changed as a result of the editing performed in response to the user operation being capable of being stored into a storage section.

6. The sound generation control apparatus as claimed in claim 1, wherein said setting section is configured for displaying, on the display screen, an image of a database placement region having a same time axis as the icon placement region, and for displaying, in the database placement region, an image indicative of the desired time range, and for adding a display identifying the set database in association with the displayed time range.

7. The sound generation control apparatus as claimed in claim 1, wherein the icon placement region has a designating coordinate axis representing a designation value designating processing content of the material data, and said sound generation control section is configured for performing control such that content of sound generation, corresponding to the material data identified on the basis of the icon image, varies in accordance with a position, on the designating coordinate axis, of the icon image.

8. The sound generation control apparatus as claimed in claim 1, wherein the icon placement region has an identifying coordinate axis representing an identification value for identifying the material data, and said sound generation control section is configured for acquiring, on the basis of a position on the identifying coordinate axis of the icon image and the feature amount information associated with the icon image, the material data from the database set in association with the time range containing the time position where the icon image is placed.

9. The sound generation control apparatus as claimed in claim 1, wherein the icon image is of a design corresponding to the feature amount information associated with the icon image.

10. The sound generation control apparatus as claimed in claim 1, wherein the icon placement region has a feature amount defining axis for defining the feature amount information, and said display control section is configured for placing and displaying the icon image in the icon placement region at a position on the feature amount defining axis defining the feature amount information associated with the icon image.

11. The sound generation control apparatus as claimed in claim 1, wherein said display control section is configured for changing, in accordance with an input instruction, a length, along the time axis, of the icon image displayed in the icon placement region, and said sound generation control section is configured for performing control such that a state of sound generation based on the material data acquired on the basis of the icon image varies in accordance with the length of the icon image.

12. The sound generation control apparatus as claimed in claim 1, wherein the icon image varies in accordance with a feature amount indicated by the feature amount information.

13. The sound generation control apparatus as claimed in claim 1, wherein said sound generation control section is configured for acquiring the material data from the database located outside said sound generation control apparatus.

14. The sound generation control apparatus as claimed in claim 13, comprising an identification section provided outside said sound generation control apparatus for identifying, from among feature amount information stored in the database set in association with the time range containing the time position where the icon image is placed, feature amount information that matches the feature amount information associated with the icon image, and wherein said sound generation control section is configured for inquiring of the identification section to identify the feature amount information matching the feature amount information associated with the icon image and for acquiring the material data from the database in accordance with the identified feature amount information.

15. The sound generation control apparatus as claimed in claim 1, comprising an identification section configured for identifying, from among feature amount information stored in the database set in association with the time range containing the time position where the icon image is placed, feature amount information that matches the feature amount information associated with the icon image, and wherein said sound generation control section is configured for inquiring of the identification section to identify the feature amount information matching the feature amount information associated with the icon image and for acquiring the material data from the database in accordance with the identified feature amount information.

16. A server apparatus for supplying material data to a sound generation control apparatus recited in claim 1, said server apparatus comprising:

a plurality of types of the databases;

a reception section configured for receiving, from the sound generation control apparatus, type information indicative of a type of the database set in association with the time range containing a time position where the icon image is displayed, and feature amount information associated with the icon image;

an identification section configured for referencing the database of the type indicated by the type information from among the plurality of types of the databases to thereby identify material data having particular relationship with the feature amount information received together with the type information; and an output section configured for retrieving the material data, identified by said identification section, from the database and for sending the retrieved material data to the sound generation control apparatus.

17. A system comprising:

a sound generation control apparatus recited in claim 1; and a server apparatus comprising:

a plurality of types of the databases;

a reception section configured for receiving, from the sound generation control apparatus, type information indicative of a type of the database set in association with the time range containing a time position where the icon image is displayed, and feature amount information associated with the icon image;

an identification section configured for referencing the database of the type indicated by the type information from among the plurality of types of the databases to thereby identify material data having particular relationship with the feature amount information received together with the type information; and an output section configured for retrieving the material data, identified by said identification section, from the database and for sending the retrieved material data to the sound generation control apparatus.

18. A computer-implemented method comprising:

displaying, on a display screen of a display section, an image of an icon placement region having a time axis and displaying, in the icon placement region, an icon image in association with a desired time position on the time axis, wherein feature amount information is associated with the icon image, the feature amount information comprising a feature amount in the form of a value descriptive of a feature of material data comprising a waveform of a sound material, the value based on the material data comprising the waveform of the sound material;

setting, in association with a desired time range on the time axis of the icon placement region, a particular database to be used, the particular database being selected from among a plurality of types of databases configured for storing material data in association with feature amount information; and acquiring, on the basis of the feature amount information associated with the icon image, the material data from the database set in association with the time range containing the time position where the icon image is placed, and generating tone data on the basis of the acquired material data and the time position where the icon image is placed.

19. A server-implemented method for cooperating with the computer-implemented method in claim 18 the server-implemented comprising:

receiving, by a server, type information and feature amount information transmitted when said acquiring step is to be performed in a terminal, the type information indicative of a type of the database set in association with the time range containing a time position where the icon image is displayed, the feature amount information associated with the icon image;

referencing, by the server, the database of the type indicated by the type information from among the plurality of types of the databases to thereby identify material data having particular relationship with the feature amount information received together with the type information; and retrieving, by the server, the material data, identified by said referencing step, from the database and sending, by the server, the retrieved material data to the terminal, wherein, when said acquiring step is to be performed in the terminal, the terminal receives the material data from the server and generates tone data on the basis of the received material data and the time position where the icon image is placed.

20. A non-transitory computer-readable storage medium containing instructions for causing a processor to perform a method comprising:

displaying, on a display screen of a display section, an image of an icon placement region having a time axis and displaying, in the icon placement region, an icon image in association with a desired time position on the time axis, wherein feature amount information is associated with the icon image, the feature amount information comprising a feature amount in the form of a value descriptive of a feature of material data comprising a waveform of a sound material, the value based on the material data comprising the waveform of the sound material;

setting, in association with a desired time range on the time axis of the icon placement region, a particular database to be used, the particular database being selected from among a plurality of types of databases configured for storing material data in association with feature amount information; and acquiring, on the basis of the feature amount information associated with the icon image, the material data from the database set in association with the time range containing the time position where the icon image is placed, and generating tone data on the basis of the acquired material data and the time position where the icon image is placed.

21. A non-transitory computer-readable storage medium containing instructions for causing a server processor to perform a server method in cooperation with the processor in claim 20, said server method comprising:

receiving, by a server, type information and feature amount information transmitted when said acquiring step is to be performed in a terminal, the type information indicative of a type of the database set in association with the time range containing a time position where the icon image is displayed, the feature amount information associated with the icon image;

referencing, by the server, the database of the type indicated by the type information from among the plurality of types of the databases to thereby identify material data having particular relationship with the feature amount information received together with the type information; and retrieving, by the server, the material data, identified by said referencing step, from the database and sending, by the server, the retrieved material data to the terminal, wherein, when said acquiring step is to be performed in the terminal, the terminal receives the material data from the server and generates tone data on the basis of the received material data and the time position where the icon image is placed.

* * * * *